US006827623B2

(12) United States Patent
Nakatake et al.

(10) Patent No.: US 6,827,623 B2
(45) Date of Patent: Dec. 7, 2004

(54) MANUFACTURING METHOD OF PLASMA DISPLAY PANELS

(75) Inventors: Fumiaki Nakatake, Saito (JP); Minoru Fukui, Miyazaki (JP); Yoshitaka Ukai, Miyazaki (JP); Shinji Kanagu, Kobe (JP); Kazuhide Iwasaki, Miyazaki (JP); Akihiro Fujimoto, Ono (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/339,199

(22) Filed: Jun. 24, 1999

(65) Prior Publication Data

US 2003/0073372 A1 Apr. 17, 2003

(30) Foreign Application Priority Data

Jun. 29, 1998 (JP) ..... 10-182178
Jun. 15, 1999 (JP) ..... 11-168418

(51) Int. Cl.[7] ..... H01J 9/26
(52) U.S. Cl. ..... 445/25; 445/24; 445/40
(58) Field of Search ..... 445/24, 25, 40, 445/43, 53, 56, 57

(56) References Cited

U.S. PATENT DOCUMENTS 5,207,607 A * 5/1993 Nagano et al. ..... 445/25
5,564,958 A * 10/1996 Itoh et al. ..... 445/42
5,697,825 A * 12/1997 Dynka et al. ..... 445/25
5,921,837 A * 7/1999 Kanagawa et al. ..... 445/25
5,997,379 A * 12/1999 Kimura ..... 445/25
6,039,620 A * 3/2000 Itoh et al. ..... 445/25
6,189,579 B1 * 2/2001 Tanaka ..... 445/40

FOREIGN PATENT DOCUMENTS

| | | |
|---|---|---|
| JP | 50-3570 | 1/1975 |
| JP | 4-2030 | 1/1992 |
| JP | 9-251839 | 9/1997 |
| JP | 9-306362 | 11/1997 |
| JP | 10-21829 | 1/1998 |

OTHER PUBLICATIONS

Machine translation of JP 09–251839 (document not prior art).*
Nagahata, Akihiro et al., "Present and future of sealing and exhausting process in plasma display panel manufacturing", Technical Report of Plasma Display, Apr. 1999, pp. 45–51 (English translation of relevant portions).

* cited by examiner

*Primary Examiner*—Nimeshkumar D. Patel
*Assistant Examiner*—German Colón
(74) *Attorney, Agent, or Firm*—Staas & Halsey LLP

(57) ABSTRACT

In accordance with the present invention, there is provided a method of manufacturing a plasma display panel of the type which includes a discharge space defined between a pair of substrates and sealed by a sealant, the method comprising a first step of forming the sealant on at least one of the substrates and stacking one substrate on the other through the intermediation of the sealant, a second step of reducing the pressure in the space existing between the pair of substrates due to the presence of the sealant and melting the sealant by heating, a third step of curing the sealant to thereby firmly attach the pair of substrates to each other and define a predetermined discharge space, a fourth step of removing impurities in the discharge space, and a fifth step of filling the discharge space with discharge gas.

36 Claims, 21 Drawing Sheets

MANUFACTURING METHOD OF PLASMA DISPLAY PANELS

BACKGROUND OF THE INVENTION

1. Field of the Invention

This invention relates to a method of manufacturing plasma display panels, referred to hereinafter as PDPs, in which a pair of substrates with a discharge space therebetween is vacuum sealed along the respective peripheries thereof, and particularly relates to a sealing method to form such a panel having such a sealed discharge space.

2. Description of the Related Art

Hereinafter is described a structure of an AC-driven three-electrode surface discharge type PDP, as representative of plasma display panels in which the present invention can be embodied. As shown in FIG. 19, a perspective and partially cross-sectional view of a PDP, there is arranged for each line L of a display matrix a pair of display electrodes X & Y upon an inner surface of a front glass substrate 50 in order to generate a surface discharge along a surface of the front substrate 50. The display electrodes X & Y may also be called sustain electrodes. The display electrodes X & Y are respectively formed of a stack, or laminate, of a wide, straight transparent electrode 52 formed of a thin film of ITO, Indium Tin Oxide, and a narrow straight bus electrode 53 formed of a thin metal film. The display electrodes X & Y are formed by means of a photolithography technique.

A dielectric layer 54 for the AC (alternating current) drive is formed on the inner surface of the front substrate 50, so as to cover the display electrodes X & Y and protect same from discharges in the discharge space, by means of a screen printing method. Upon dielectric layer 54 is deposited a protecting layer 55 formed of MgO, Magnesium Oxide.

On the other hand, upon an inner surface of a back glass substrate 51 there are arranged, in order to generate address discharges, address electrodes 56, orthogonal to the display electrodes X & Y and spaced by a constant pitch. The address electrodes 56 as well preferably are formed of a stack, or laminate, of metal films by means of a photolithography technique.

Upon the entire inner surface of the back glass substrate 51, including the portions above the address electrodes 56, there is formed a dielectric layer 57 by means of a screen printing method and, further, thereupon is provided a plurality of approximately 150 $\mu$m high straight separator walls, or barriers, 58 each centered between a respective pair of adjacent address electrodes 56. Fluorescent materials 60, of three primary colors R (red), G (green) and B (blue) for a full color display, are coated so as to cover the surface of dielectric layer 57 including the respective, exposed portions above corresponding address electrodes 56 and the sides of the separator walls 58, by means of a screen printing method.

Within discharge space 59 is filled a discharge gas, such as typically a mixture of Ne—Xe, i.e. neon gas and xenon gas, of several hundreds Torr, for exciting the fluorescent materials by irradiating thereon ultra-violet rays during the gaseous discharge. A sealant (seal-glass layer) 61 is provided for sealing the discharge space 59 at the respective peripheral portions of the substrates 50 and 51.

Front glass substrate 50 and back glass substrate 51 are separately prepared, and finally sealed together with sealant 61 so as to form the sealed discharge space therebetween. The structure of the PDP is thus completed.

Referring to FIGS. 20A, 20B and 21, hereinafter is described a prior art method of manufacturing the PDP, including a step to form the discharge space shielded from the external space (i.e., the surrounding exterior space) with the above described sealant 61. FIGS. 20A and 20B illustrate a cross-sectional view and a plan view, respectively, of a PDP in a step for peripheral edge sealing; and FIG. 21 illustrates heating and exhausting processing cycles as a function of time.

Sealant 61 shown in FIGS. 20A and 20B has been formed by coating a glass paste on the back glass substrate 51 and, next, solidifying the paste during preparing of the back glass substrate. The thus prepared sealant is melted once during the sealing step and solidified again so as to join front glass substrate 51.

As shown in FIG. 20B, during the prior art process of sealing a PDP 71, a front glass substrate 73 and a back glass substrate 72 are stacked with a layer of sealant 74 between their respective peripheries and are clamped with several clips 77 at the peripheries thereof. Clips 77 both fix the glass substrates 72 and 73 relatively to each other as well as impose a predetermined pressure onto the peripheral portions to be sealed while the sealant 74 is melted.

That is, in order to form the discharge space 76 during the sealing process using sealant 74, it is necessary to melt the sealant 74 placed between the paired glass substrates 72 and 73 by heating same and to deform, i.e. press, the paired glass substrates 72 and 73 together so as to have the gap therebetween defined by the height of the separator walls. Accordingly, a pressure has to be imposed in a direction such that the paired glass substrates 72 and 73 approach each other. Several clips 77 are needed to generate the required pressure.

At the periphery of the back glass substrate 73, a conduction pipe (a glass pipe) 75 is provided so as to make a channel connecting the discharge space 76 and the outside (i.e., the exterior) of the PDP 71. The space 76 is exhausted of ambient air and then filled with a discharge gas via the pipe 75. During the prior art sealing process, a pair of the substrates 72 and 73, each of about 3 mm thickness, may be damaged by a stress due to direct clamping with many clips 77. Accordingly, it is necessary to seal the pair of substrates 72 and 73 while weakly clamped over a long time process.

The illustrative prior art method is explained in more detail with reference to FIG. 21, showing processing cycles in above described prior art. The pair of substrates 72 and 73, clamped with many clips 77 as shown in FIG. 20B, is carried into a furnace (not shown) for heating and then the seal head 5 (not shown) is closely mounted to the pipe 75. The seal head is connected to a pump for exhausting, and then to gas cylinders for gas filling (not shown in FIG. 20A).

While keeping (i.e., maintaining) such a state, a heater for heating the furnace is operated first so that the temperature inside the furnace is gradually raised so as to reach a melting temperature $T_m$ of the sealant 74. This heating period is illustrated as a temperature-raising period T1. Next, the temperature inside the furnace is kept at the melting temperature $T_m$ of sealant 74 for a predetermined period, which is illustrated as a first temperature-holding period T2. During the temperature holding period T2, sealant 74 is melted so as to allow both the front and back glass substrates to reach a predetermined gap therebetween defined by the height of the separator walls (e.g., as shown at 58 in FIG. 19) by the pressure of clips 77 as shown in FIGS. 20A and 20B.

The first temperature holding period T2 is a relatively long period because the process, during the temperature holding period T2, has to be carried out while the substrates 72 and 73 are clamped with clips having weak, or low, pressure as described above. When the gap between front glass substrate 72 and back glass substrate 73 reaches the predetermined gap size defined by the height of the separator walls, the temperature inside the furnace is decreased down to a solidifying temperature of sealant 74. This period is illustrated as a temperature-lowering period T3. During these periods of to T3, neither exhausting nor gas-filling is carried out from/into a discharge space 76 sealed by the sealing process.

Next, the temperature as lowered during the temperature lowering period T3 is held for a predetermined period, namely, a second, temperature holding period T4. This lowered temperature nevertheless is at a relatively high level, but such that sealant 74 does not melt. Upon beginning the second temperature-holding period T4, discharge space 76 is exhausted via an exhausting tube 75. This exhausting process is carried out in order to remove impurities existing in discharge space 76; accordingly, the temperature is kept at the high temperature T4 of second temperature holding period T4 sufficiently high as to drive out impurity gases adsorbed by the dielectric layers and the protection layers. The second temperature-holding period T4 is chosen according to the period required to complete removal of the impurity gases from the discharge space 76.

Next, the temperature inside the furnace is lowered by terminating the heater, as illustrated by a second temperature lowering period T5, during which the exhausting operation is continued so as to further remove the impurities. Upon completion of the impurity removal from the discharge space 76 and stabilization of the temperature inside the furnace at room temperature, illustrated as a room temperature period interval T6, a discharge gas is introduced, instead of the exhausting, via the conduction pipe 75 by switching a valve (not shown) provided on a pipe connected to the conduction pipe. The discharge gas is typically a mixture of neon gas and xenon gas.

By completing the processing cycle described above, the front glass substrate 72 and the back glass substrate 73 are sealed together by the sealant so as to form the discharge space 76 between these substrates 72 and 73.

In the above described prior art method, there is a possibility of breaking glass substrates 72 and 73 due to the stress caused from the many clips 77 directly contacting glass substrates 72 and 73. Therefore, the sealing process is carried out over a relatively long period with a weak dipping pressure.

Accordingly, a long period is required for the first temperature-holding period T2, that is a sealing process, resulting in the lowering of the process efficiency. Non-uniformity of the clip pressure may cause a local stress or cause an insufficiently pressed portion, whereby the glass substrate may be broken or may be incompletely sealed. The impurity removal from the discharge space, via the conduction pipe 75 only, also may cause a long exhausting period and insufficient purity in the discharge space.

SUMMARY OF THE INVENTION

It is a general object of the invention to provide a method of manufacturing a plasma display panel comprising a pair of substrates separated by a gas discharge space, which method is suitable for high efficient mass production and includes a process for reliably sealing of, and removal of impurities from, the gas discharge space.

The present invention provides a method of manufacturing a plasma display panel based on a feature that sealing a periphery of the pair of substrates is carried out with use of a force caused by a pressure difference between an interior of and an exterior of the pair of substrates during melting of the sealant. More specifically, the present invention provides a method of manufacturing a plasma display panel which comprises, sequentially, a first step of forming the sealant in a frame-shape on a periphery of at least one of the substrates and stacking one of substrates onto the other via the sealant, a second step of lowering the pressure in the space, closed with the sealant, between the stacked pair of substrates and of heating the sealant for melting same as so as to compress the sealant and define a gap between the substrates, a third step of curing the sealant, once melted, to glue and fix firmly the pair of substrates to each other and form a discharge space between the pair of the substrates, and a fourth step of removing impurities out of the discharge space.

In the method according to the present invention described above, the pair is pressed toward each other, pressing the sealant by the force due to the pressure difference between the outside and the inside of the pair, during melting of the sealant by heating. Accordingly, the external force applied to the pair may be minimized, a local stress caused in the prior art is decreased and the period for sealing the pair may be shortened, by the method of the present invention. The present invention is also desirable for high efficient mass-production of the panels owing to applying the method to a sealing process in the production process where a plurality of plasma display panels is cut out from a single pair of large substrates.

Further, the present invention provides a manufacturing method based on a feature that the gap of the discharge space in the three-electrodes surface discharge type PDP described above is maintained by a plurality of separator walls or ribs separating the discharge space and formed in a predetermined pattern on the inner surface of substrate. The method for sealing along the periphery of the pair of substrates at an interval, or distance, therebetween determined by the height of the walls, includes a step of forming, previously, on one of substrates a sealant in a frame-shape higher than that of the walls and of setting an assembly of the pair of substrates in a furnace able to heat and exhaust therein, and of exhausting the outside of the pair and in turn as well the inside during melting of the sealant.

Owing to the above described invention, the present invention may improve the dynamic and/or display characteristics, because exhausting the residual solid and/or gaseous impurities in the discharge space via a leakgap at a contact-portion of the sealant and the substrate is available in a period until the beginning of the sealant melting.

The invention described above improves color purity of light emitted from fluorescent material, which is formed on one of the pair, particularly on the back substrate, as well as the separator walls in the plasma display panels subject to the present invention, because heating to melt the sealant is carried out in forming a vacuum and also sufficient purification due to the use of pressure difference between in and outside of the pair is completed. On the other hand, the luminous characteristics, such as a color temperature, in plasma display panels produced via a prior art manufacturing method is poor due to a damage caused in a process in the method.

The above-mentioned features and advantages of the present invention, together with other objects and advantages, which will become apparent, will be more fully described hereinafter, with references being made to the accompanying drawings which form a part hereof, wherein like numerals refer to like parts throughout.

DESCRIPTION OF THE PREFERRED EMBODIMENT

With reference to drawings, preferred embodiments of the present invention are hereinafter described in detail.

Figure 1:
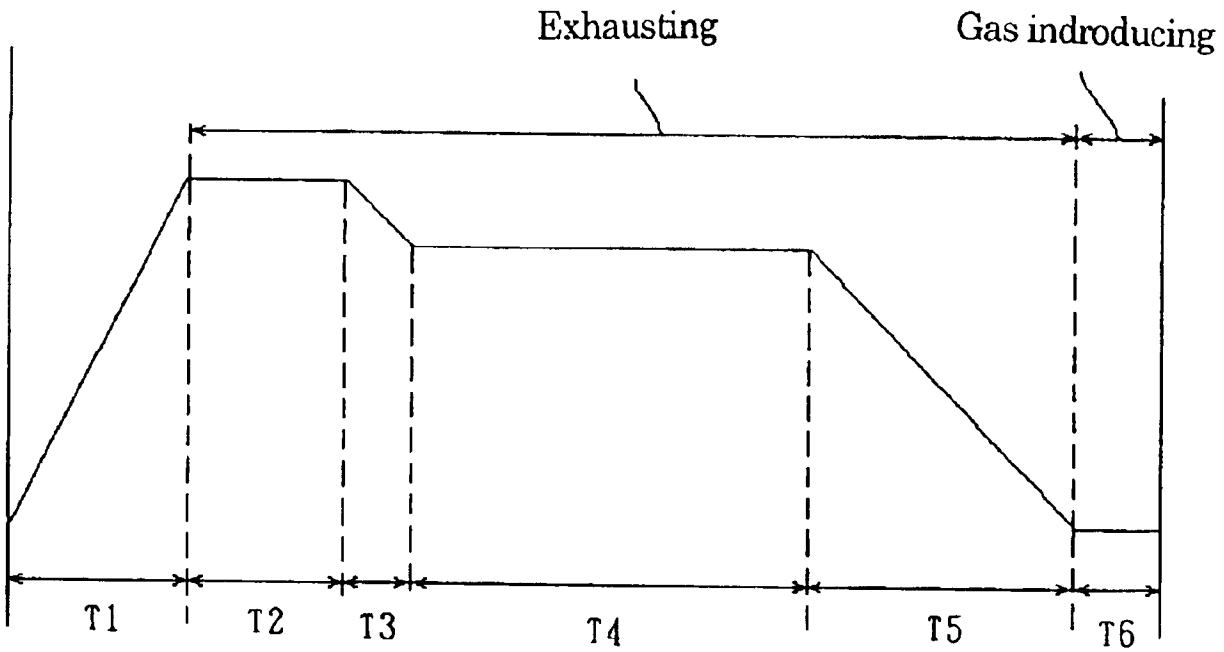
FIG. 1 is a chart schematically illustrating basic processing cycles for time elapsed in the process of the present invention.
Figure 2A:
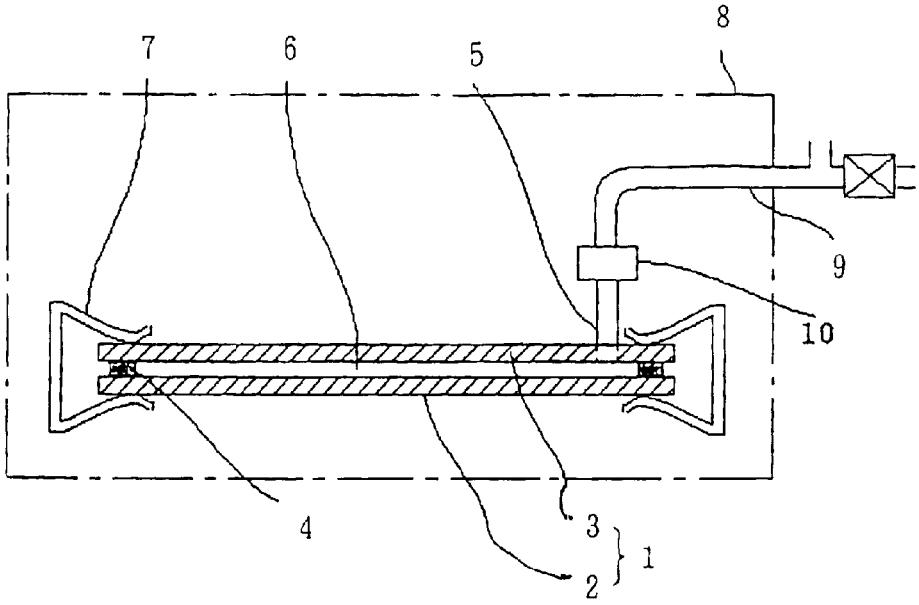
FIG. 2 schematically illustrates a cross sectional view of a PDP at a sealing step of the present invention.
FIG. 2B schematically illustrates a plane view of a PDP at a sealing step of the present invention.
Figure 2B:
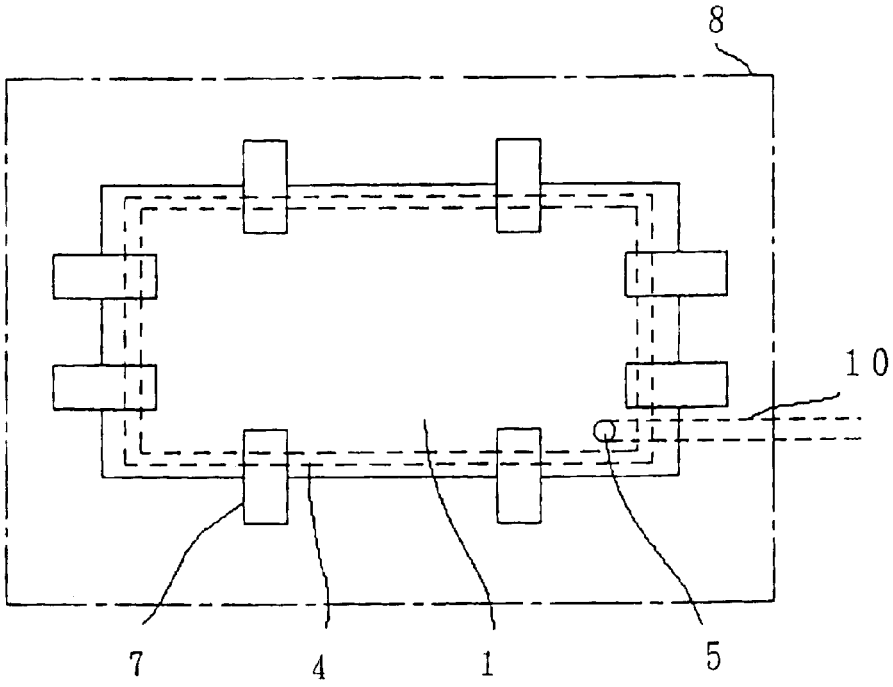

FIG. 1 is a chart schematically illustrating basic processing cycles for elapsed time. FIGS. 2A and 2B schematically illustrate a state of a PDP at a sealing step according to the method of the present invention.

A principle of the present invention is now described, referring to FIG. 1 and FIGS. 2A and 2B.

According to the present invention, a pressure to press a sealant (a seal-glass layer) to be melted during the sealing process is supplied by generating a pressure difference between the inside of the paired glass substrates and the outside thereof. That is, the pressure inside the discharge space is kept low by exhausting the discharge space so that the sealant is pressed, as a result of the reduced interior pressure caused by the exhausting, relative to the exterior pressure, in a direction such that the substrates approach each other.

Accordingly, the many previously employed clips for applying a weak, or light, pressure are no longer necessary, and only a few clips suffice for preventing relative positional displacement of the substrates and tentatively fixing the substrates relatively to each other for the sealing process.

FIGS. 2A and 2B illustrate a cross-sectional cut view and a plan view, respectively, of the state of PDP in this sealing process.

A PDP 1 according to the present invention is formed of a front glass substrate 2 and a back glass substrate 3, which are pinched together about their respective peripheries with clips 7 while a sealant 4 in a shape of a frame is placed therebetween at their respective peripheries. Upon inner surfaces of front glass substrate 2 and back glass substrate 3 are formed electrodes, a dielectric layer and separator walls which, however, are not illustrated in FIGS. 2A and 2B to simplify the drawings.

It should be noted that, as is apparent from FIG. 2B, only a few clips 7 are provided so as to adequately prevent a mutual deviation or separation of the substrates, and less pinching pressure is required than in the prior art.

PDP 1 is placed in the furnace 8 so as to be processed for the heating, the exhausting and the gas introduction steps. In a practical furnace 8, though not illustrated in the drawings, there are provided plural shelves to carry the plural PDPs 1, aligned horizontally as well as vertically, so as to be processed at the same time according to the hereinafter described processing cycles shown in FIG. 1.

As shown in FIG. 1, the temperature inside the furnace 8 gradually is raised until reaching a melting temperature of the sealant 4 (seal-glass layer) through a temperature-raising period T1. Then, the temperature inside the furnace 8 is held for a predetermined period, shown as a temperature holding period T2. At this temperature holding period T2 is started the exhausting operation via pipe 5.

As the sealant (seal-glass layer) 4 which has been prepared in a solidified state on the substrate is melted and becomes adhesive during temperature holding period T2, a gap between the sealant and the substrate vanishes and an exhausting operation via the pipe lowers the pressure inside the discharge space 6 and causes an external pressure to exert a force in a direction to press the substrates 2 and 3 toward each other so that melted sealant 4 is pressed to be deformed so as to make the height of the discharge space 6 the same as the predetermined gap defined by the separator walls.

When the gap between the paired glass substrates 2 and 3 becomes the predetermined value, the temperature inside the furnace 8 is lowered to a temperature of the solidifying temperature of sealant 4 during a temperature lowering period T3, during which as well the exhausting operation is continued.

Next, the temperature, lowered during the temperature lowering period T3, is held for a predetermined period called a temperature holding period T4. This temperature is set relatively high but at such a level that the sealant does not melt. During the temperature holding period T4, the exhausting process is continued.

The exhausting operation during and after the temperature lowering period T3 is performed in order to remove the impurities existing in discharge space 6; accordingly, there is provided a temperature holding period T4 for maintaining a relatively high temperature such that the removal of impurity gas (hydrocarbon and so on) and moisture adsorbed in the dielectric layer or the protection layer can be accelerated.

The holding period T4 is determined according to a period by which the impurity gases are removed from the protection 5 layer, etc. to an extent that the remaining amount thereof becomes so little as to have no effect on the characteristics of the PDP. Next, the heater of the furnace is shut down so as to lower the temperature inside the furnace 8 for a temperature lowering period T5, during which the exhausting operation is continued so as to remove further impurities.

When the impurities within discharge space 6 are removed and the temperature inside the furnace 8 is stabilized, at a room temperature period T6, instead of an exhausting operation a discharge gas is introduced into the discharge space via pipe 5. The discharge gas is typically a mixture of neon gas and xenon gas, and can be introduced by opening a valve provided in pipe 9, and by shutting the exhaust valve and shutting down the exhaust pump.

Next, without breaking the vacuum inside the discharge space 6, the conduction pipe 5 is removed and the through hole provided for the conduction pipe on the back glass substrate 3 is closed so as to complete the PDP 1.

According to the above described processing cycles of the present invention, the sealant 4 can be pressed and deformed by adjusting the internal pressure of the discharge space without imposing an external pressure directly onto the substrates 2 and 3. No stress directly contacting the glass substrates allows a short sealing period, owing to a rapid exhausting process lowering the inside pressure down to a predetermined value. Further, the exhaustion can remove impurities from the discharge space.

Figure 3A:
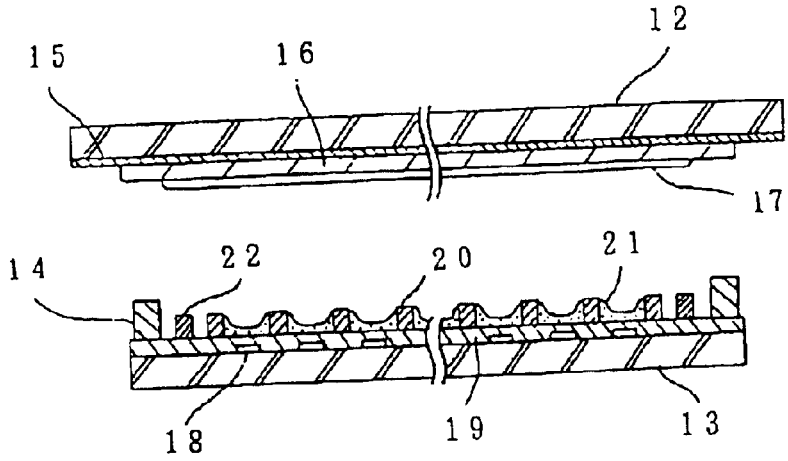
FIG. 3A schematically illustrates a cross-sectional view of a PDP before stacking substrates together, in a first preferred embodiment of the present invention.
Figure 3B:
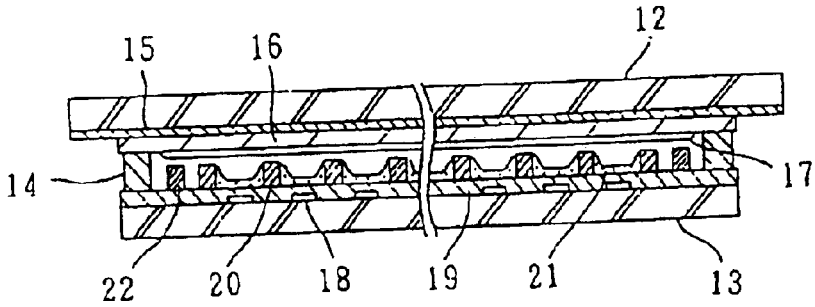
FIG. 3B schematically illustrates a cross-sectional view of a PDP shown in FIG. 3A with the substrates stacked together.
Figure 3C:
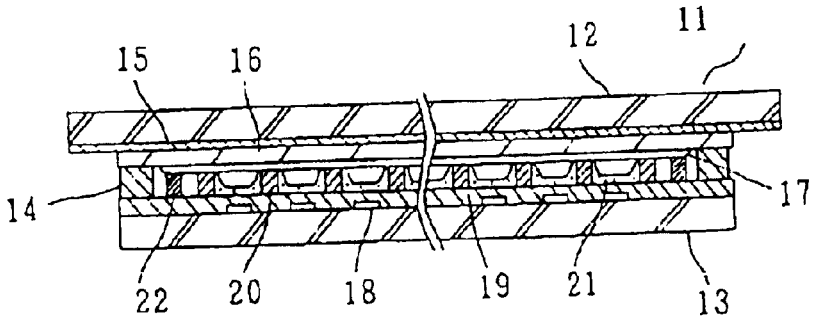
FIG. 3C schematically illustrates a cross-sectional view of a PDP after sealing a pair of the stacked substrates shown in FIG. 3A.
Figure 4:
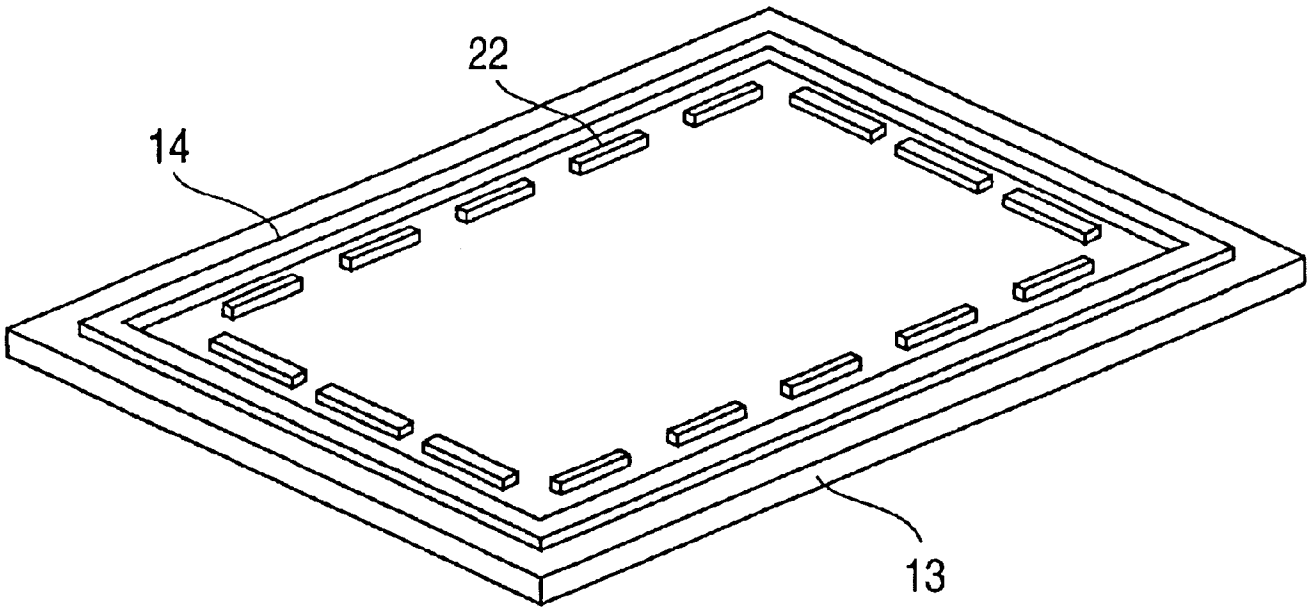
FIG. 4 schematically illustrates a perspective view of a back glass substrate in accordance with a first preferred embodiment of the present invention.

FIGS. 3A, 3B, 3C, 4, and 5 describe a first preferred embodiment of the present invention. FIGS. 3A, 3B and 3C are cross-sectional views schematically illustrating the internal structure of a PDP being processed, until sealed. FIG. 4 is a perspective view of the back glass substrate on which the sealant is formed. FIG. 5 schematically illustrates processing cycles.

Upon front glass substrate 12 are formed display electrodes 15, dielectric layer 16 and protection layer 17 as shown in FIG. 3A. Upon back glass substrate 13 are formed address electrodes 18, dielectric layer 19, separator walls 20 for defining discharge spaces and discharge gaps and fluorescent material 21 placed between separator walls 20, sealant 14 and barrier walls 22 for preventing an inward invasion of sealant 14.

The panel structural components such as electrodes, dielectric layer, separator walls and fluorescent material are formed by the use of well-known processes, such as photolithography and screen printing.

The perspective view of FIG. 4 illustrates more clearly the construction of sealant 14 and barrier walls 22. Sealant (seal-glass layer) 14 is formed in a shape of a frame on the periphery of back substrate 13. Barrier walls 22 are formed, intermittently spaced via predetermined openings, adjacent an inner side surface of sealant 14, spaced therefrom by a small clearance - - - . Barrier walls 22 are for preventing an invasion of sealant 14 into the display area when the discharge space is exhausted. Openings between adjacent barrier walls provide exhausting paths.

The address electrodes and dielectric layer are omitted from FIG. 4 in order to simplify the description, and only sealant 14 and barrier walls 22 are drawn therein.

The front and back glass substrates 12, 13 are stacked so as to form the state illustrated in FIG. 3B. In order to prevent substrate deviation, the thus stacked substrate pair is fixed with clips having so weak a spring force as to impose substantially no stress on the substrates. At this state, there is a clearance between the separator walls 20 and the front substrate 12, reduced by the thickness of the protection film 17, because the front substrate 12 is supported by the sealant 14 formed on the back substrate 13, as seen in FIG. 3B. Further, gaps exist between the sealant 14 and the substrate because a top portion of the sealant 14 is not entirely flat.

The thus, tentatively fixed pair of substrates 12 and 13 is placed in the furnace so as to start the heating and exhausting process. The state in the furnace is shown in FIGS. 2A and 2B.

Figure 5A:
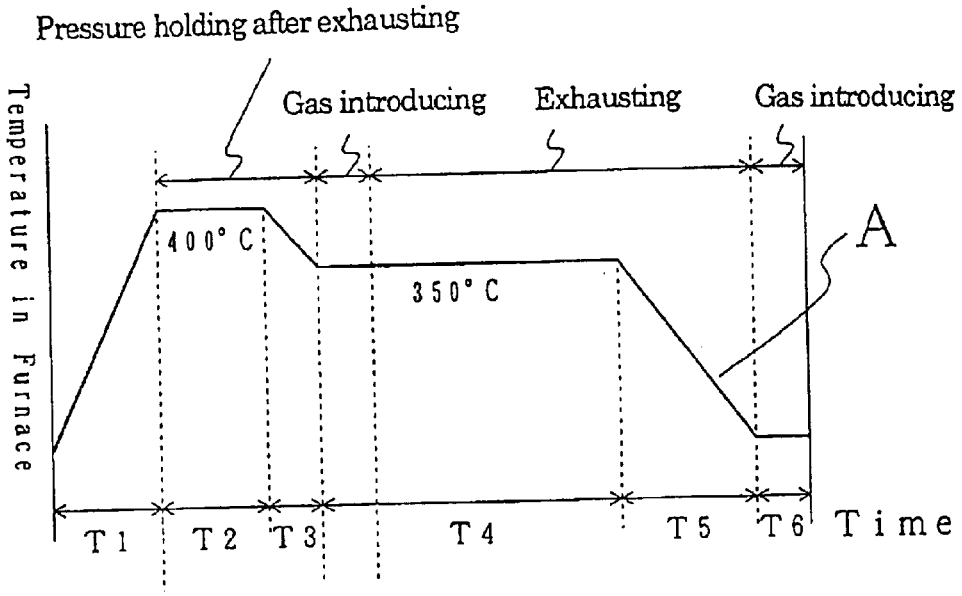
FIG. 5 schematically illustrates a temperature profile and a pressure profile in processing cycles of a sealing process in accordance with the first preferred embodiment of the present invention.
Figure 5B:
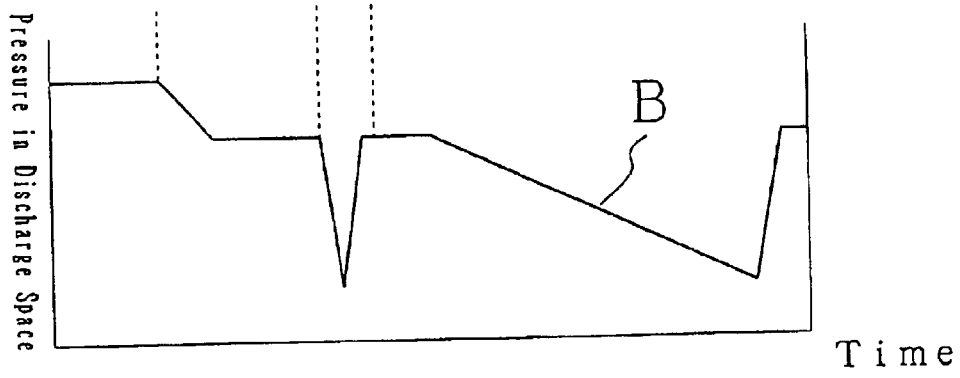

FIGS. 5A and 5B show temperature and pressure profiles, respectively, of a processing cycle.

Within the furnace the temperature is gradually raised, by switching the heater on for temperature raising period T1, up to typically 400° C. as shown in the processing cycles by the profile A in FIG. 5A because the sealant 14 employed in the preferred embodiment is formed mainly of a low melting temperature, glass typically of a 400° C. melting temperature. The furnace temperature reaching to 400° C. causes the sealant to melt and then the top of the sealant 14 is glued to the front substrate 12. So the gap between the sealant and the substrate vanishes. Accordingly, the discharge space between the front and back substrates 12 & 13 is sealed airtight.

Next, the temperature 400° C. to melt the sealant is held for a predetermined period, i.e. temperature holding period T2.

During temperature holding period T2 the exhausting operation is started, as shown in FIG. 5B, so as to make the internal pressure a predetermined lowered pressure, typically about 50,000–70,000 Pa (Pascal). This internal pressure is necessary for deforming the sealant 14 so as to pull the front glass substrate 12 and the back glass substrate 13 toward each other, and is appropriately determined according to the material of sealant 14 and the volume of the discharge space, etc.

When the internal pressure of the discharge space becomes the desired pressure (50,000–70,000 Pa), the exhaust operation is terminated so as to maintain the lowered internal pressure. At this time, owing to the sealant being melted and the lowered internal pressure, the front glass substrate 12 and the back glass substrate 13 are pressed to each other, compressing the sealant 14. Terminating the exhaust prevents the melting sealant from flowing into the discharge space.

After the predetermined period has elapsed, the front and back glass substrates 12 and 13 are pushed to each other and reach the relative, spaced positions at which they are supported on the separator walls 20 as shown in FIG. 3C. In the first preferred embodiment, the temperature-holding period T2 is typically set at 10 minutes, which adequately provides the desired discharge space.

Next, the temperature inside the furnace is lowered down to the solidifying temperature of sealant 14 during temperature lowering period T3, so as to finish the sealing operation with sealant 14. Next, the temperature, lowered during temperature lowering period T3, is held for a predetermine period of temperature holding period T4. This temperature is set at typically 350° C., which is relatively high but is of a level which does not melt the sealant 14.

During a first half of the temperature holding period T4, exhaust is begun again until the inner pressure is reduced, or lowered, to around 104 PA. Then, a discharge gas mixture of Neon and Xenon is introduced via the pipe 5 to the discharge space, and then an exhausting operation is started again. The gas introduction now carried out is to wash out the impurities inside the discharge space. The introduction of the discharge gas into all the corners of the discharge space and re-exhaustion thereof allow more certain removal of the impurities. A continuation of temperature holding period T4 thereafter for a predetermined period is to accelerate the impurity gas generation and exhaustion from the dielectric layer 16 and 19 and protection layer 17, etc . . . .

Furthermore, during the exhausting period immediately after temperature holding period T4, a gas aging operation is carried out by applying a predetermined voltage onto the address electrodes. This aging process is to stabilize the address electrodes.

Temperature holding period T4 is set according to a period after which the gas generation from the panel structual components is no longer observed. Next, the temperature inside the furnace is lowered during temperature lowering period T5 by terminating the operation of the heater. During this period, as well, the exhaust is carried out so as to remove further impurities.

When the impurities in the discharge space are removed and the temperature inside the furnace is stabilized at the room temperature, shown as a room temperature period T6, the discharge gas, i.e. the mixture of neon and xenon gases, is introduced, in place of the exhausting, via the pipe 5.

After finishing these processes, the glass substrate pair 12 and 13 is stacked with each other so as to form a desired discharge space defined by the separator walls 20 therebetween and the discharge gas is introduced into the discharge space.

According to the first preferred embodiment, it is possible to shorten the sealing step, i.e. temperature holding period T2, which required several hours in the prior art method, down to several tens of minutes. Furthermore, less labor is required to fix the reduced number of clips improving production efficiency.

Furthermore, the thickness of the sealed portions was measured at several points of the POP produced in the first preferred embodiment, and it was found that the measured values were substantially equal to the specified values; accordingly, desired sealing was completed.

Moreover, the brightness and the color purity of the PDP were improved compared with the case of the prior art employing clip pressure. And the color temperature was improved by an increase of around 20% and the current values were also stable. These improvements probably were due to the more precisely formed discharge space, sufficient exhaust of impurities and avoidance of performing a process in air at high temperature.

Figure 6:
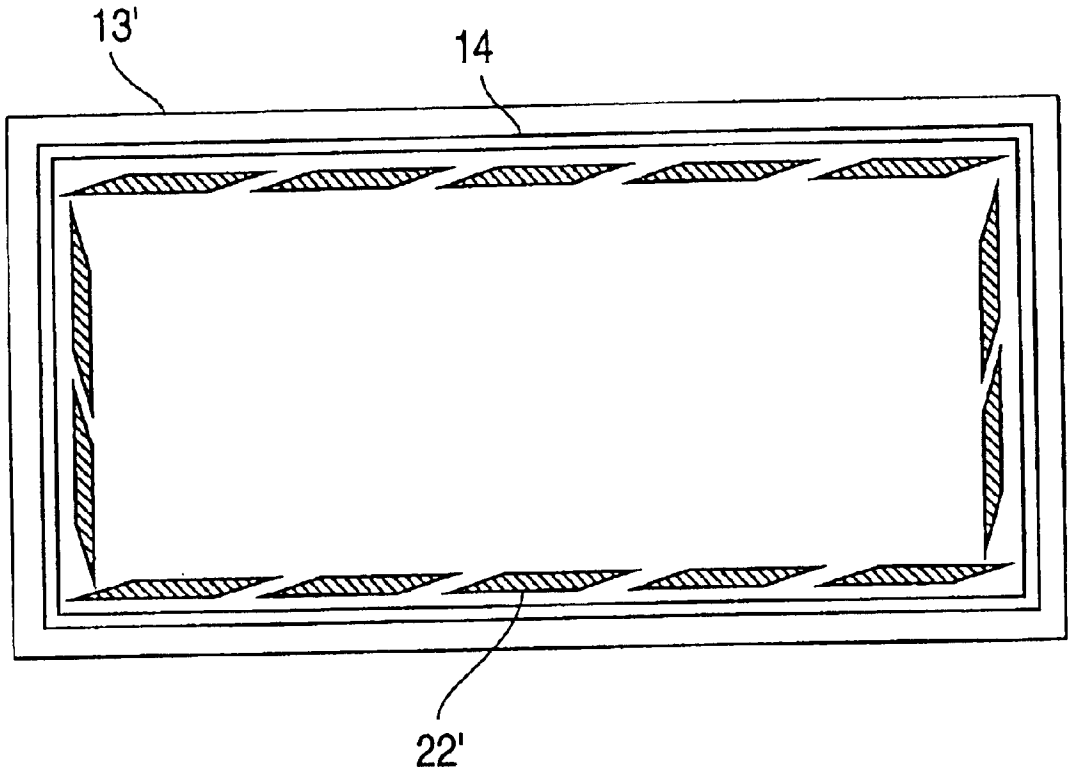
FIG. 6 schematically illustrates a plane view of a modified back glass panel in accordance with the first preferred embodiment of the present invention.

As shown in FIG. 6, inside a sealant 14 of back glass substrate 13' are provided protection walls 21' having exhaust paths extending along a slanted direction with respect to the sealant 14. Such a shape of the protection walls 22' allows sure portion of sealant 14 while exhausting paths are secured.

The protection walls 22 of the first preferred embodiment are provided in order to protect against the melted sealant, during exhausting of the discharge space, from invading the display area; however, proper selection of the exhausting pressure and exhausting period serve to hold the substrates in position without pulling in the sealant. Accordingly the protection walls 22, are not always necessary.

Figure 7A:
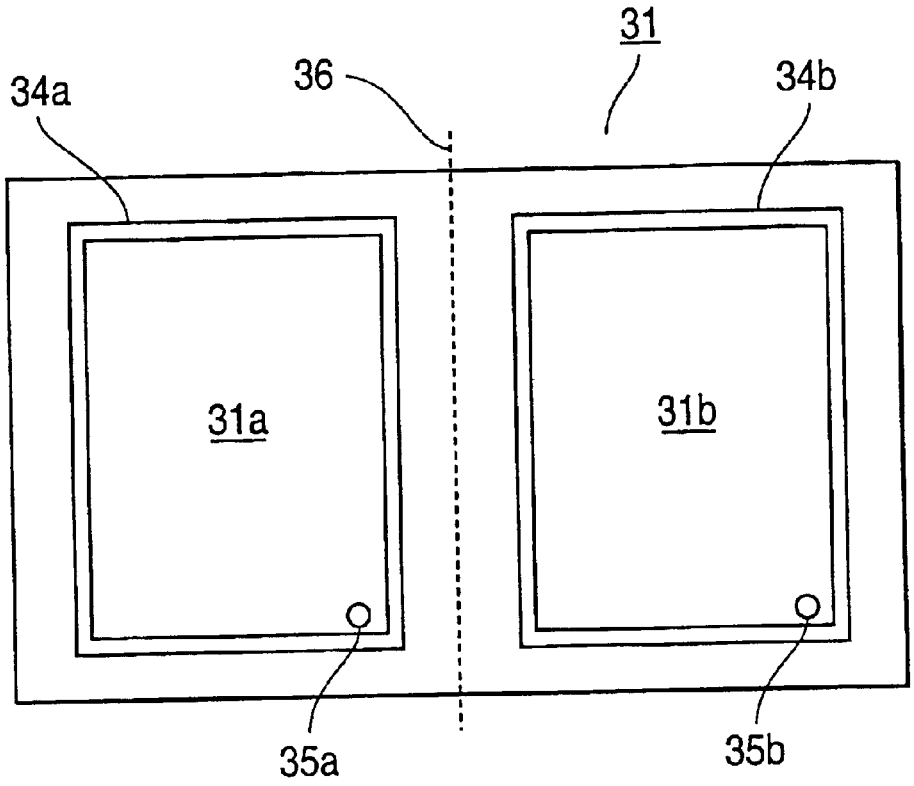
FIG. 7A schematically illustrates a plane view of a PDP in accordance with a second preferred embodiment of the present invention.
Figure 7B:
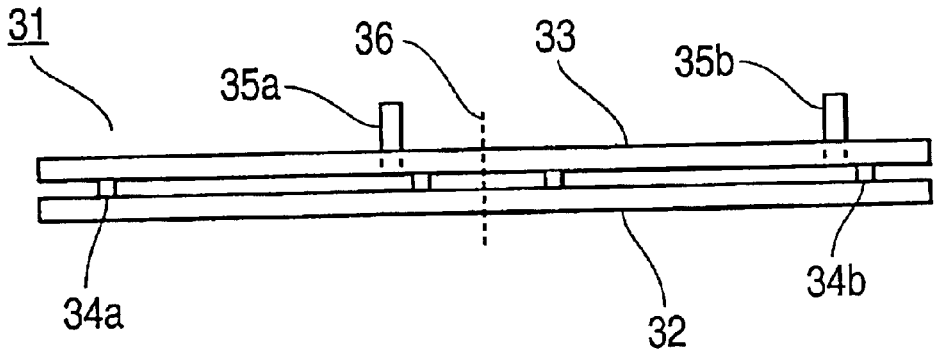
FIG. 7B schematically illustrates a cross-sectional view of the PDP shown in FIG. 7A.

FIGS. 7A and 7B show a PDP structure 31 according to a second embodiment of the manufacturing method of the present invention. FIG. 7A is a plan view, and FIG. 7B is a sectional view. In this embodiment, a plurality of panels are simultaneously formed, which makes the present invention particularly suitable.

To effect mass production efficiently, a method has come to be adopted in which a plurality of PDP panel substrates are obtained from a single glass substrate (a pair of opposing substrates). In this method, the components of a plurality of panels, such as electrodes, dielectric layers, and separator walls, which are for a plurality of PDPs, are simultaneously formed on a large glass substrate. Then, the large glass substrate is cut and divided into individual panels, whereby a plurality of PDPs are finally obtained, thereby achieving an improvement in terms of production efficiency.

The a PDP 31 shown in FIGS. 7A and 7B (what is composed of two PDPs 31*a* and 31*b* and is also referred to as a "PDP"), and the patterns of the electrodes, dielectric layers, etc. are changed as described above to thereby form two PDPs simultaneously.

Between a front glass substrate 32 and a back glass substrate 33, both of which are large enough to be formed into the two PDPs 31*a* and 31*b*, there are arranged two frame-like sealants 34*a* and 34*b*, side by side. Further, the back glass substrate 33 has two conduction pipes 35*a* and 35*b* which are in the respective areas surrounded by the sealants 34*a* and 34*b*, respectively.

Unlike the case in which only one PDP is formed from a single substrate and in which the sealant is formed only in the peripheral portion of the substrate, when two sealants 34*a* and 34*b* are thus formed, the sealants are arranged also in the central portion of the glass substrate. Thus, in the conventional technique in which the sealant is pressurized by a clip, the portion of the sealant in the central portion of the substrate cannot be pressurized. In view of this, it is necessary to provide a jig (i.e., a large clip or the like) for pressurizing the portion of the sealant material in the central portion of the glass substrate from above and below, with the result that the device becomes rather large.

In the present invention, in contrast, the pressurizing force to be applied to the sealant material is obtained by reducing the pressure in the discharge space, so that no such clip (including a large clip) is needed. Thus, even in the case in which the sealant material exists in the central portion of the glass substrate as in this embodiment, the sealing can be effected easily and reliably.

The PDP 31 shown in FIGS. 7A and 7B is put in a heating furnace in this condition, and undergoes sealing and exhausting processes.

In the heating furnace, different seal heads are attached to the conduction pipes 35*a* and 35*b* and the exhaust of the discharge spaces and the introduction of discharge gas are effected through different piping systems.

The processing cycle after this is the same as that of the first embodiment shown in FIGS. 5A and 5B, so a description thereof will be omitted. After this processing cycle, as in the first embodiment, discharge gas is introduced and the conduction pipes 35*a* and 35*b* are removed. Then, the PDP 31 is taken out of the heating furnace, and the front glass substrate 32 and the back glass substrate 33 are cut along the central cutting line 36, thereby completing the two PDPs 31*a* and 31*b* simultaneously.

In this embodiment, described above, when forming two PDPs simultaneously in order to enhance mass productivity, it is possible to reliably effect the sealing without having to apply pressure from outside to the central portion of the glass.

Figure 8A:
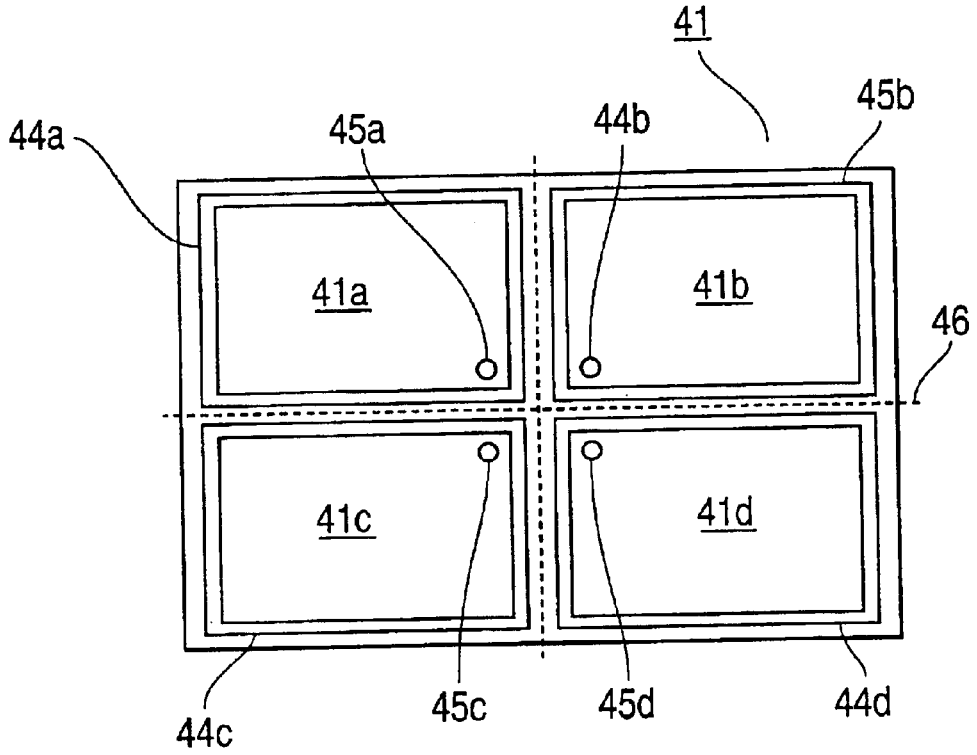
FIG. 8A schematically illustrates a plane view of a PDP in accordance with a third preferred embodiment of the present invention.
Figure 8B:
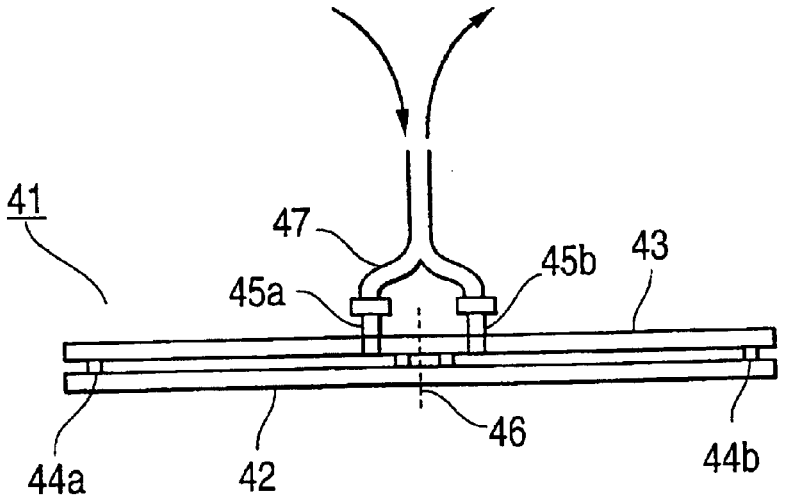
FIG. 8B schematically illustrates a cross-sectional view of the PDP shown in FIG. 8A.

FIGS. 8A and 8B show a PDP according to the third embodiment of the present invention. FIG. 8A is a plan view, and FIG. 8B is a sectional view. In this embodiment, to further enhance mass productivity as compared to the second embodiment, four PDPs are simultaneously formed.

The PDP 41 shown in FIGS. 8A and 8B (is comprised of four PDPs 41*a* to 41*d* l(and is also referred to as a "PDP"), and the patterns of the electrodes, dielectric layers, etc. are changed as described above, whereby the four PDPs 41*a* to 41*d* are simultaneously formed.

In this embodiment, a large glass substrate is divided into four areas by cutting lines, and frame-shape sealants 44*a*, 44*b*, 44*c* and 44*d* are respectively arranged in the four areas. Further, four conduction pipes 45*a*, 45*b*, 45*c* and 45*d* are respectively arranged in the areas surrounded by the sealants.

The four conduction pipes 45*a*, 45*b*, 45*c*, and 45*d* are provided in the portions of the back glass substrate 43 which correspond to the central portion of the substrate where the four areas are adjacent to each other, whereby it is possible to effect the exhaustion and the introduction of discharge gas simultaneously through a common piping.

As shown in FIG. 8B, in the heating furnace, the four conduction pipes 45*a*, 45*b*, 45*c*, and 45*d* of the PDP 41 of this embodiment are connected to a single piping 47 through seal heads. Thus, when the exhaustion and the introduction of discharge gas are effected through the piping 47, as indicated by arrows, processing is simultaneously effected in the individually formed discharge spaces.

The processing of the PDP 41 in the heating furnace is the same as that of the first embodiment shown in FIGS. 5A and 5B, so a description thereof will be omitted. Since the pressure of the discharge spaces is reduced with the sealants 44*a*, 44*b*, 44*c*, 44*d* being melted, it is possible to easily perform sealing without applying pressure from outside.

As in the second embodiment, in this third embodiment, the sealants are arranged also in an area (central portion) other than the peripheral portion of the glass substrate. However, as described above, the sealing is effected by obtaining the pressure for pressurizing the sealants by reducing the pressure in the discharge spaces, so that the sealing of the central portion can be reliably effected.

After thus effecting the sealing, the removal of impurities in the discharge spaces and the introduction of discharge gas are effected and, further, the conduction pipes 45*a*, 45*b*, 45*c*, and 45*d* are removed. After this, the PDP 41 is taken out of the heating furnace, and the front glass substrate 42 and the back glass substrate 43 are cut along the cutting lines 46, whereby four PDPs are simultaneously completed.

In this embodiment, described above, when forming four PDPs 41*a* to 41*d* simultaneously to enhance mass productivity, it is possible to reliably effect the sealing of the central glass portion without applying pressure from outside.

Further, since the conduction pipes 45*a*, 45*b*, 45*c*, and 45*d* are provided close to each other in the central portion of the back glass substrate 43, and the exhaustion and the introduction of discharge gas is effected through the common piping 47, the construction of the exhaust system is simplified, and the control thereof is facilitated.

In the embodiment described above, the gas is introduced into the discharge space as to remove the impurities out of the space during the temperature-holding period T4. The effect, similar to that in the embodiment described above, is obtained in the process in which the temperature holding period T2 shown in FIG. 5 is set longer, and a discharge gas, N2 gas, or Ar gas is introduced into the space after ten minutes after the beginning of the T2, and then the exhaust of the space is begun again.

In the embodiment described above, the exhaust is begun when the inner temperature of the furnace reaches around the temperature of the sealant melting. The exhaust may be begun in the state in which the temperature is lower than the temperature of the sealant melting.

Figure 9A:
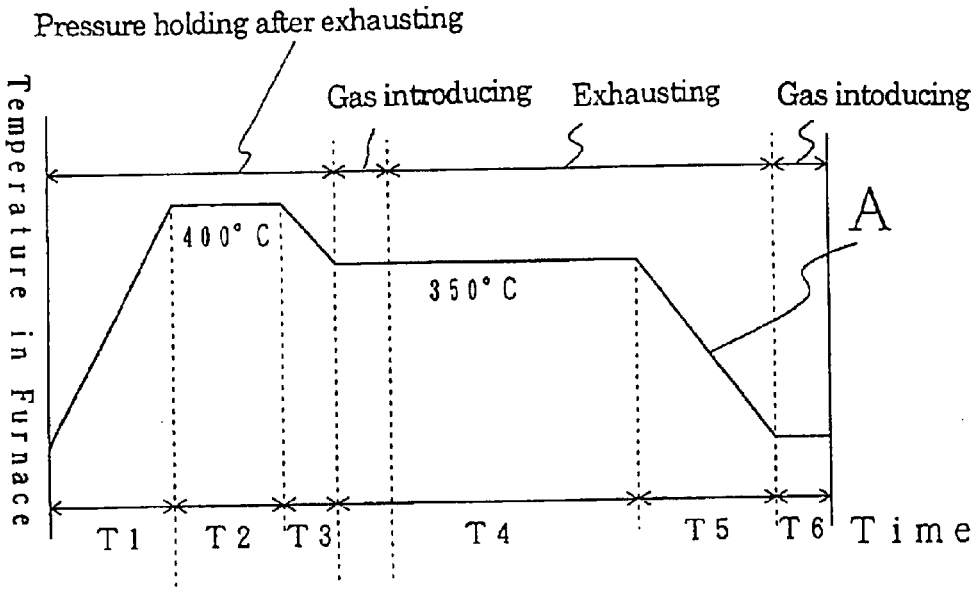
FIG. 9 schematically illustrates a temperature profile and a pressure profile in processing cycles of a sealing process in accordance with a fourth preferred embodiment of the present invention.
Figure 9B:
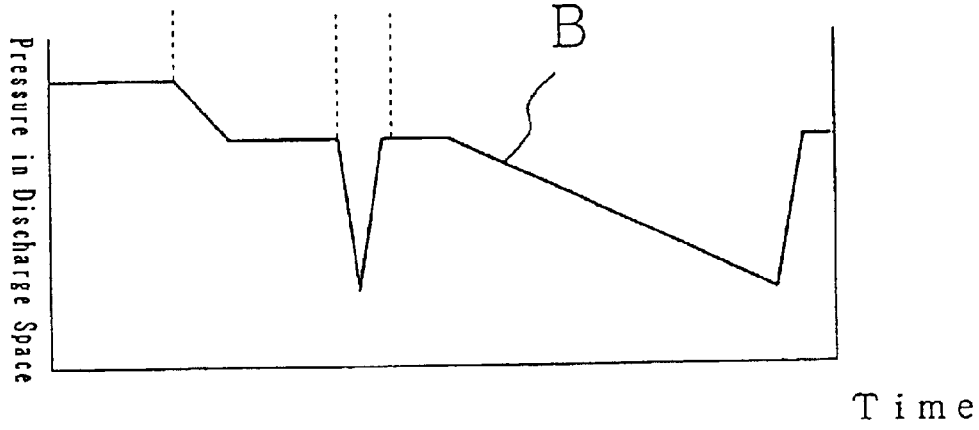

In a fourth embodiment as shown in FIGS. 9A and 9B, the beginning of the exhaust is synchronous with the beginning of the heating process in the furnace. The profiles of temperature and pressure in the fourth preferred embodiment are shown in FIG. 9A and FIG. 9B, respectively. In the embodiment, the exhaust is begun at the beginning of the temperature raising period T1 in FIG. 9A and terminated once with half of the temperature holding period T2. As shown by the profile in FIG. 9B, owing to simultaneous beginning of the temperature raising and the exhausting via the conduction pipe, the pressure in the discharge space is held to the pressure at around the beginning of the temperature holding period T2 and then is decreased after the furnace temperature reaches 400° C.

The pressure, that is, does not change while the temperature 15 in the furnace is below the sealant melting temperature, because a gas (air) in the furnace is inhaled (i.e., introduced) into the discharge space via a gap between a un-melted sealant and the front glass substrate. That is, the heated-air-flow, ambient to the pair of the substrates, is introduced into the discharge space and sent out from the space via the conduction 20 pipe. The heated-air-flow removes any impurity, such as hydrocarbon, etc. to the exterior of the pair of substrates. Accordingly, the removal of the impurity from the discharge space is performed more effectively.

Then after the temperature in the furnace reaches the sealant melting temperature, the pressure in the discharge space is 25 decreased by exhausting and then kept constant by terminating the exhaust, owing to the discharge space being maintained in an airtight state, by eliminating the gap by virtue of the sealant melting and connecting the stacked substrates.

In the fourth embodiment, since the exhaust is begun before the sealant melting and the heated-air-flow removes the impurity in the space, the removal of the impurity from the space is performed more effectively. It is preferable to fill the furnace with N2 gas, etc. to improve the effect of purification in the discharge space.

Figure 10:
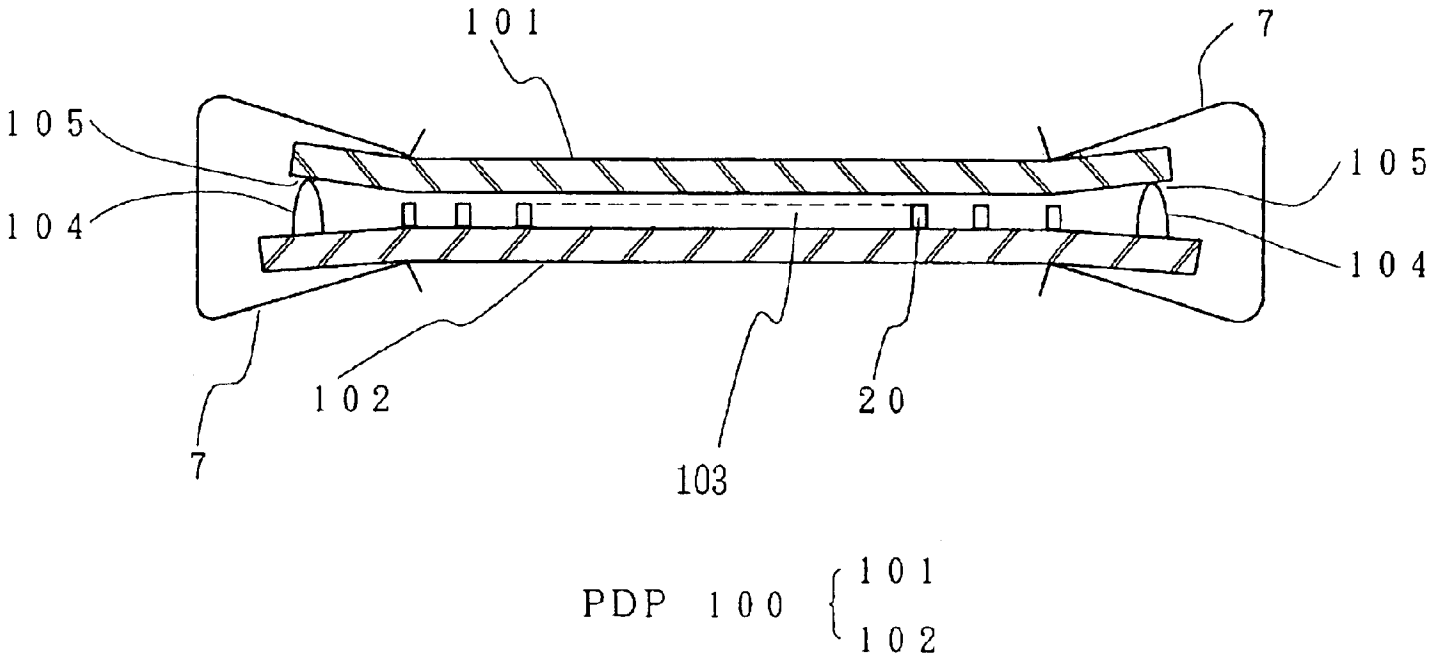
FIG. 10 schematically illustrates a cross-sectional view of a PDP in accordance with a sealing process of a fifth preferred embodiment of the present invention.
Figure 11:
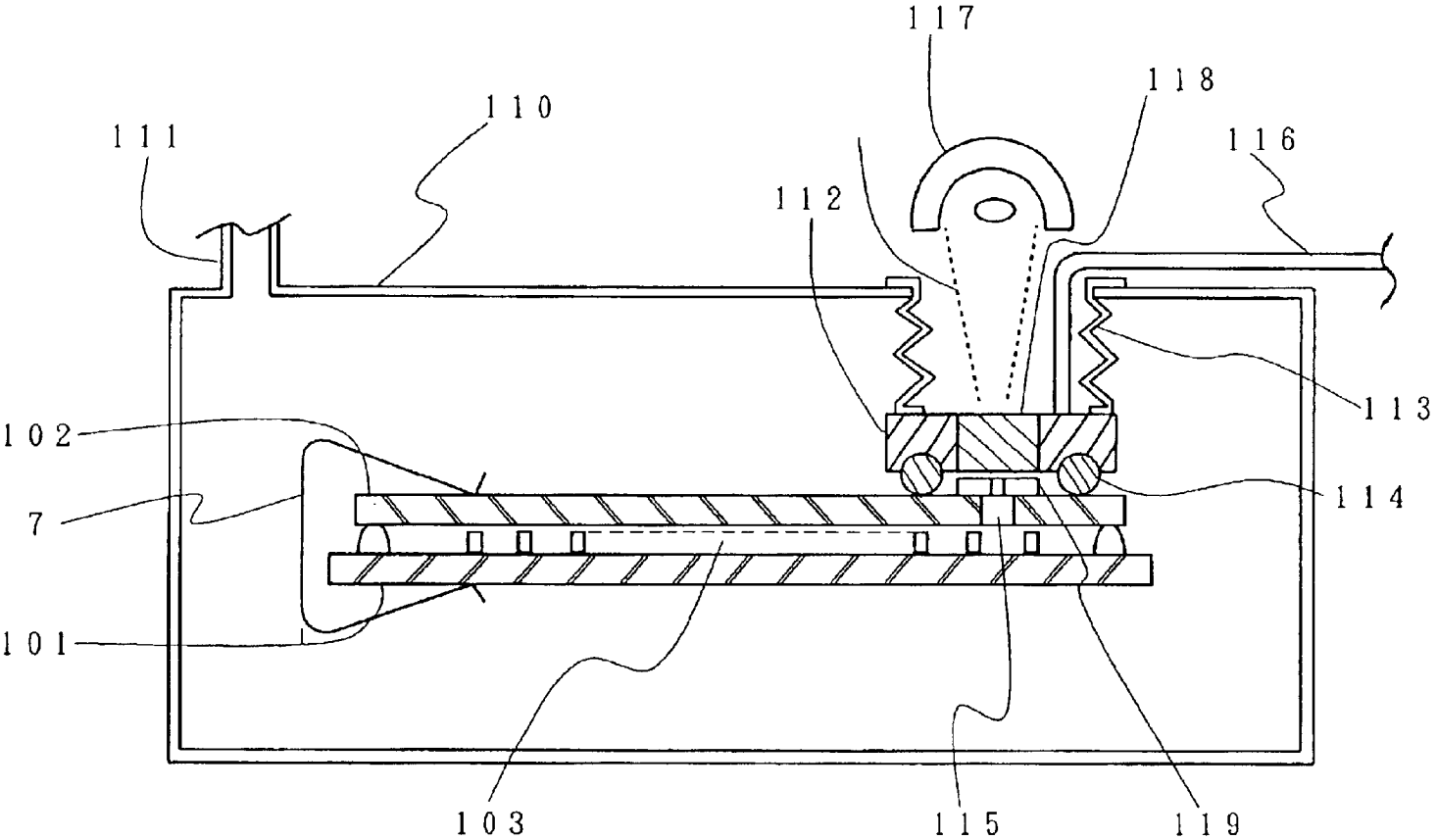
FIG. 11 schematically illustrates a cross-sectional view of the PDP shown in FIG. 10.
Figure 12:
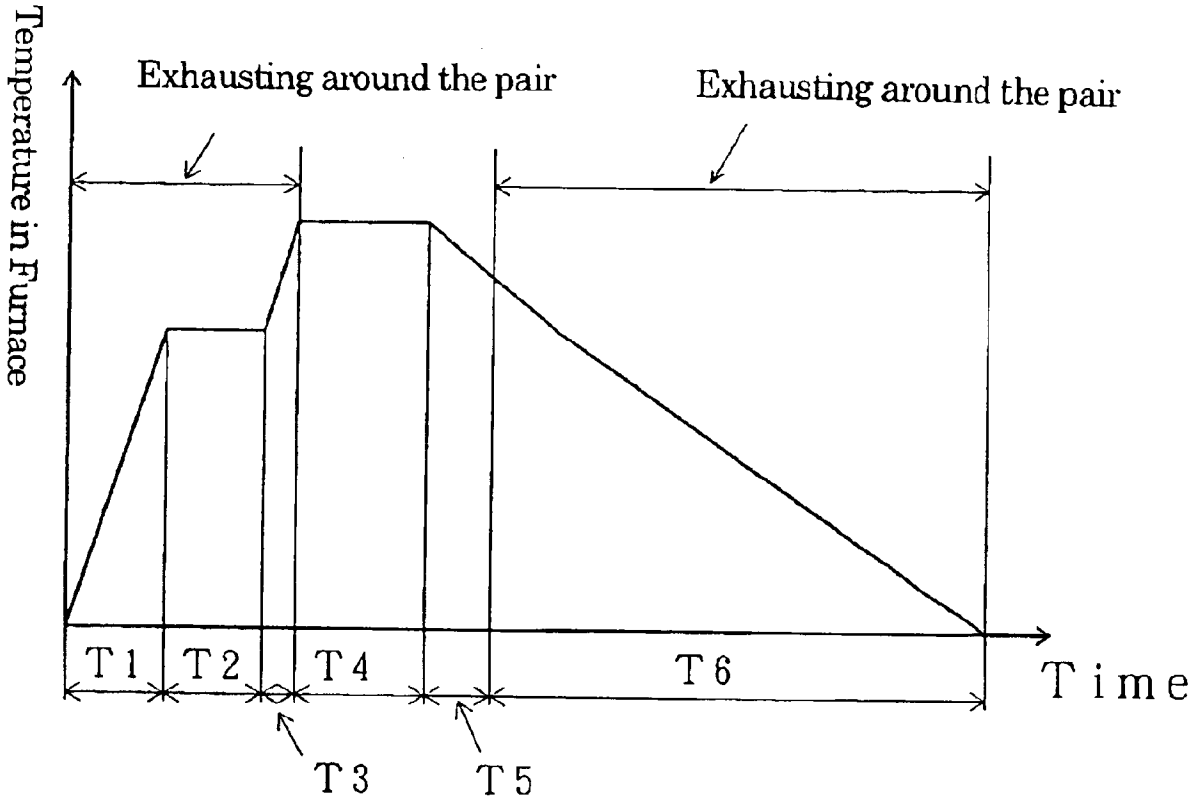
FIG. 12 schematically illustrates a temperature profile in a processing cycle of a sealing process in accordance with the fifth preferred embodiment of the present invention.

FIGS. 10 through 12 illustrate the fifth embodiment of the present invention. FIG. 10 is a sectional view showing a pair of glass substrates 101 and 102 superimposed one upon the other, FIG. 11 illustrates the sealing process with the pair of substrates 101 and 102, and FIG. 12 illustrates a processing cycle. As in the first embodiment, various electrodes, a dielectric layer, a protective layer, separator walls, a fluorescent substance, etc. are arranged variously on the front glass substrate 101 and the back glass substrate 102.

The fifth preferred embodiment is different from the first to the fourth embodiments in that, the gaseous impurity in the discharge space is exhausted via a gap, which is formed between the sealant and the substrate, prior to the sealant melting.

The front glass substrate 101 and the back glass substrate 102 are stacked together, and are secured in position by a plurality of clips 7 formed of a heat resistant and elastic material such as an alloy of iron, nickel, chrome and molybdenum. The clips 7 are mounted at positions near the separator walls 20 in close proximity to sealant 104 of a discharge space 103 defined between the front glass substrate 101 and the back glass substrate 102. The clamping force of the clips 7 is adjusted such that the top portion of the separator walls 20 is in close contact with an MgO protective layer (not shown) of the front glass substrate 101. This adjustment of the clamping force may be effected by selecting the most preferable ones of clips 7 of various levels of clamping force, prepared in advance. Here, the stacking together of the front glass substrate 101 and the back glass substrate 102 is completed. What is important in this process is that the top portions of the sealant 104, between the stacked together front glass substrate 101 and back glass substrate 102, are such that there is a gap 105 which allows free movement therethrough of gas, due to slight variations in the formation of the sealant material 104 and warpage of the glass substrates 101 and 102.

A shaped frit glass 119, formed in advance, is arranged in alignment with a throughhole 115 in substrate 102 of the pair of stacked substrates 101 and 102 (hereinafter referred to as "PDP 100") (See FIG. 11). This shaped frit glass 119 is secured to the back glass substrate 102 by a resin which decomposes by low-temperature heating such that it does not move when the PDP 100 is transferred.

Next, this PDP 100 is put in a vacuum heating furnace 110 capable of evacuation while being heated. This vacuum heating furnace 110 is heated by a heater (not shown), and the interior of the furnace can be evacuated by a vacuum pump (not shown) connected thereto by way of an outlet 111, creating a high vacuum state in the furnace. Further, as described below, an ascent/descent type seal head 112 for effecting the exhaust of the discharge space 103, only, and the filling of the discharge space 103 with discharge gas, is provided in the vacuum heating furnace 110 through the intermediation of a bellows 113.

In this vacuum heating furnace 110, the PDP 100 undergoes the processing cycle shown in FIG. 12. Simultaneously with the starting of the heating of the vacuum heating furnace 110, the evacuation (or exhausting) of the furnace is started. The sealant 104 used in this embodiment has a softening point of approximately 420° C. to 440° C. and the melting start temperature is approximately 370° C. to 390° C. As is known to those skilled in the art, the softening point is the temperature in which the strain of a glass in the form of fiber of 0.75 mm in diameter and 235 mm long is 1 mm/min, and the viscosity is approximately 107.6 noise. Around 350° C. to 370° C., which is immediately before the melting start temperature, the gap 105, shown in FIG. 10, in the sealant 104 is still maintained. Thus, in this temperature range, it is possible to exhaust the impurity gas remaining in the space of the PDP 100 through this gap 105 from around the PDP 100, this temperature range being one which enables the impurity gas to be removed most efficiently. In view of this, the substrate temperature is temporarily maintained constant until the impurity gas is removed (period T2 in FIG. 12).

Next, the temperature is raised to around 400° C. to 410° C. (period T3 in FIG. 12) to soften the sealant 104. At this time, the viscosity of the sealant 104 is such that it starts to deform by the stress of the front glass substrate 101 and the back glass substrate 102 due to the clamping force of the clips 7 but such that it does not deform without this stress. This deformation proceeds until the height of the sealant 104 becomes the same as that of the separator walls 20, and then the deformation stops.

Further, in the sealant 104, there exist minute bubbles which have been therein since the time of formation and temporary baking of the sealant material 104. When the periphery of the PDP 100 is evacuated to produce a low pressure state, there is a fear that these minute bubbles will become large bubbles as the viscosity of the sealant 104 is reduced. When such large bubbles exist, the sealant 104 cannot maintain the hermeticity of the discharge space 103 of the plasma display panel, and the reliability of the panel can, deteriorate.

In view of this, the pressure within the furnace and thus surrounding an exterior of the PDP is temporarily raised in the process of raising the temperature of the pair of substrates from 370° C. to 410° C. (period T3 in FIG. 12). By this operation, any minute bubbles are not allowed to become extremely large, and the reliability can be ensured.

This temporary rise in pressure can be effected by causing an inert gas such as Ar or discharge gas to leak into the vacuum heating furnace 110. At this time, there is an optimum value of the in-furnace pressure according to the balance with respect to the viscosity of the sealant 104.

When the temperature of the sealant is below the temperature of the softening point of the sealant, the bubbles enlarge, even in the state of a pressure of several tens of kPa or more. Further, in a case that the temperature of the sealant is around the temperature at which the sealant begins softening, that is, in a state of high viscosity, the bubbles do not occur in the state of a pressure below several tens of Pa. A suitable pressure to prevent the bubbles form growing is dependant on the temperature of the sealant.

As the temperature of softening point of the sealant in the embodiment is 420° C. 440° C., the sealant is processed below 410° C. to avoid the bubble-occurrence.

Usually, a pressure of several tens of kPa, which is somewhat lower than atmospheric pressure, is applicable for practical use. Further, since the pressure rises as a result of de-gassing according to the temperature rise and lapsed time, the vacuum pump connected to the outlet 111 is controlled such that the in-furnace pressure of the vacuum heating furnace 110 is constantly kept low.

Further, to enhance the reliability of the hermeticity of the sealant 104, it is important to minimize the probability of the existence of minute bubbles in the temporarily baked sealant 104. For this purpose, apart from optimizing the de-binder-profile, etc. when temporarily baking the sealant 104, it is effective to perform de-bubble baking by high-temperature baking or baking in an atmosphere controlled in advance.

Next, to further soften the sealant 104, the temperature of the PDP 100 is maintained around 400° C. to 410° C. (period T4 in FIG. 12). This period T4 is the period necessary for the deformation of the sealant 104. In this embodiment, it is from approximately several to several tens of minutes.

Next, the procedure advances to the step of cooling the PDP 100 (periods T5 to T6 in FIG. 12). The interior of the furnace is exhausted again at a temperature of around 350° C. to 400° C., at which the sealant 104 cures, and the temperature is reduced to room temperature while maintaining the high vacuum.

Next, the ascent/descent type seal head 112 is attached so as to cover the through-hole 115 and the shaped glass frit 119.

The construction of this ascent/descent type seal head 112 will be described with reference to FIG. 11. At the portion where the ascent/descent type seal head 112 is in contact with the back glass substrate 102, there is provided a vacuum seal 114 to maintain the vacuum. Due to this vacuum seal 114, the ascent/descent type seal head 112 can be pressurized and brought into close contact with the back glass substrate 102, whereby the hermeticity of the vacuum heating furnace can be maintained. Further, this ascent/descent type seal head 112 is provided with an exhaust/gas-introduction piping 116 for exhausting and filling with discharge gas. A vacuum pump and cylinders of gases constituting discharge gas (not shown) with which to fill the discharge space 103 are connected to this exhaust/gas-introduction piping 116 by way of a switch valve. Further, this ascent/descent type seal head 112 is provided with a quartz glass window 118, through which infrared rays from an infrared irradiation lamp 117 can be applied to the shaped glass frit 119.

Until the vacuum seal 114 is brought into close contact with the back glass substrate 102, the interior of the discharge space 105 is temporarily exhausted preferably by way of the exhaust/gas-introduction piping 116, with this ascent/descent type seal head 112 being lowered. After this, this discharge space 103 is filled with a predetermined discharge gas. Next, infrared rays from the infrared irradiation lamp 117 are applied through the quartz glass window 118 to the shaped glass frit 119, which is formed of a material having a high infrared absorption rate, to thereby melt the shaped glass frit 119, thereby sealing the through-hole 115.

In the fifth embodiment, the sealant 104 is higher, i.e., of a greater height, than the separator walls 20, and, when the glass substrates 101 and 102 are stacked together, a gap 105 is defined between the pair of substrates and the sealant 104, the impurities in this gap 105 being removed by exhausting the periphery of the pair of substrates before the melting of the sealant 104, so that the impurities adhering to or contained in the sealant 104 can be removed without allowing them to pass through the discharge space 103, whereby it is possible to prevent the discharge space 103 from being contaminated. Further, it is also possible to remove the impurities in the discharge space 103 before it is hermetically closed.

Further, a material having a high softening point is used for the sealant 104, and it is made possible to perform the removal of impurity gas before the fusing of the sealant 104 at a temperature as high as possible, whereby the removal of impurities can be effected more reliably, and it is possible to improve the operating characteristics of the plasma display panel.

Further, since it is possible to efficiently remove impurities, the exhaustion period at high temperature can be shortened. Further, in this embodiment, the exhaustion and the filling with discharge gas of the discharge space 103 are conducted without using any ducts, the conveyance, handling and installation of the PDP in the production process are facilitated.

Figure 13:
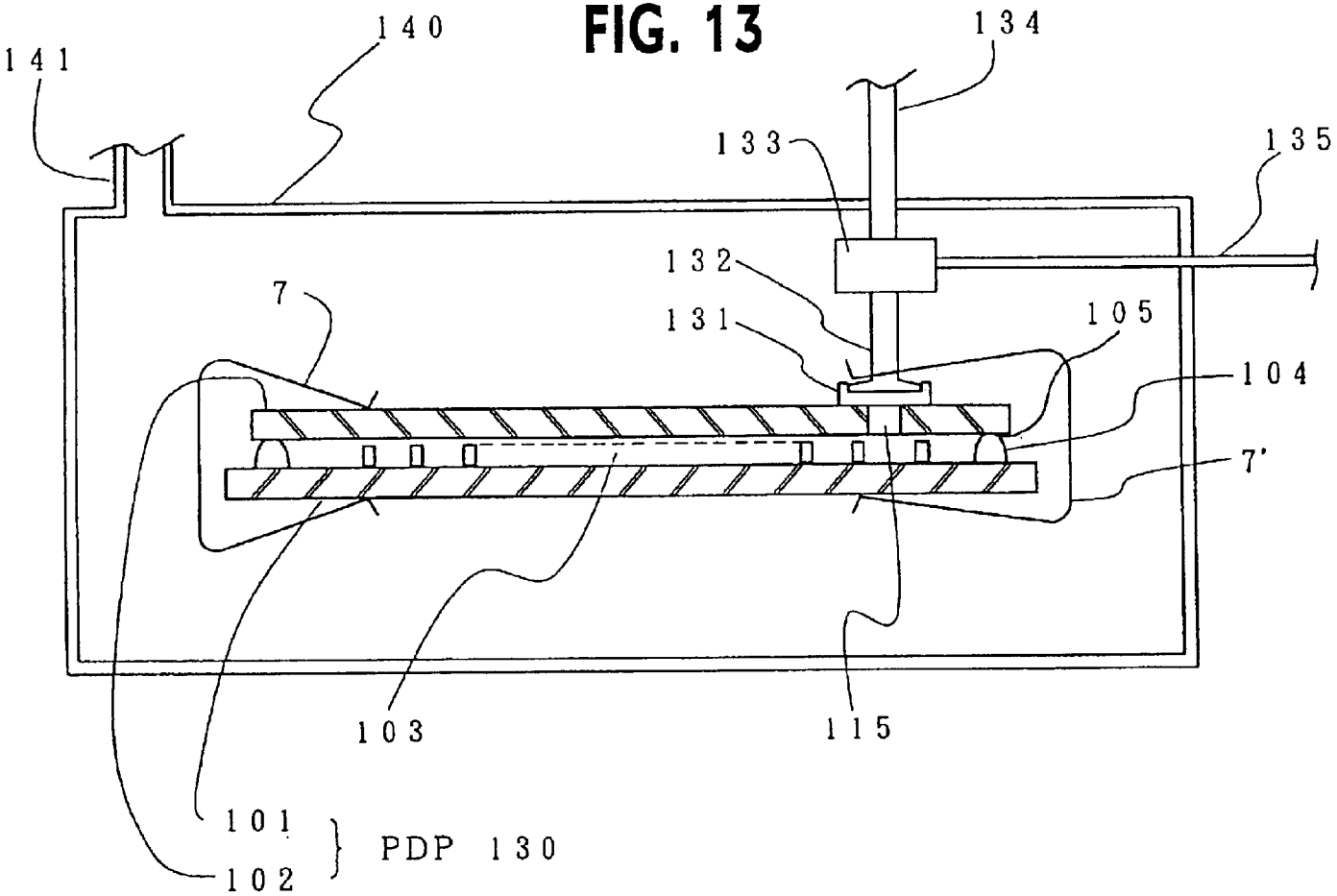
FIG. 13 schematically illustrates a cross-sectional view of a PDP in accordance with a sealing process of a sixth preferred embodiment of the present invention.
Figure 14:
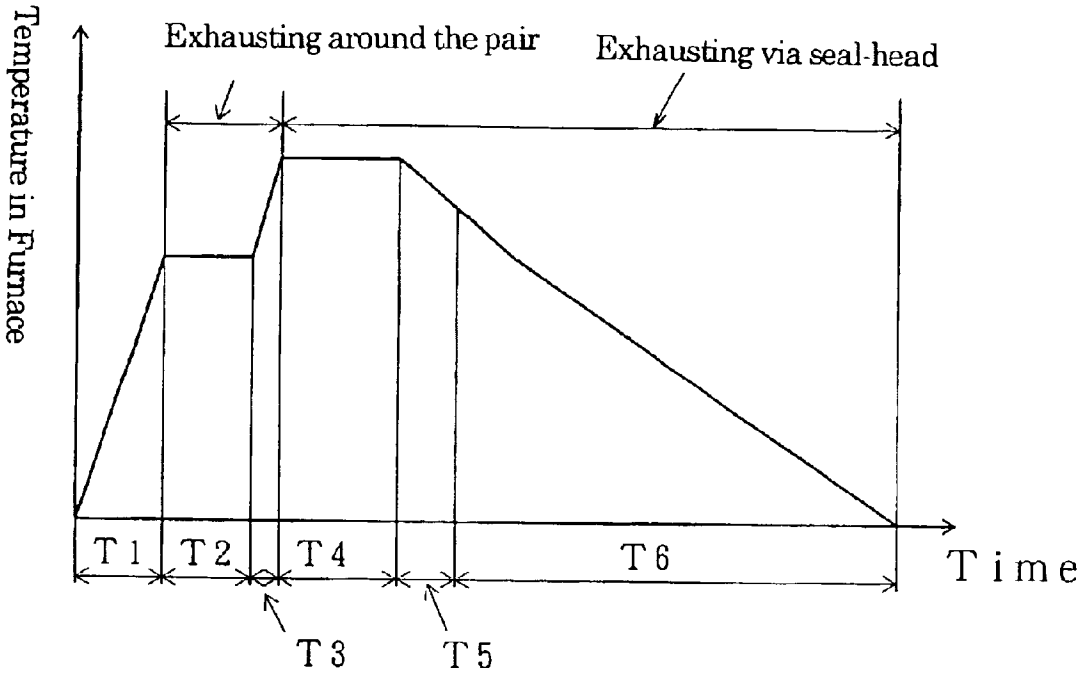
FIG. 14 schematically illustrates a temperature profile in processing cycles of a sealing process in accordance with the sixth preferred embodiment.

Next, FIGS. 13 and 14 show the sixth embodiment of the present invention. The sixth embodiment provides a method for mass production which is more easily realized in the form of a unit. FIG. 13 is a schematic diagram showing processing of a PDP 130 including a pair of substrates 101 and 102, and FIG. 14 is a schematic diagram showing a processing cycle. The components, having the same functions as those of the first through fifth embodiments, are indicated by the same reference numerals and a description thereof will be omitted.

The front glass substrate 101 and the back glass substrate 102 are formed in the same manner as in the fifth embodiment. As in the fifth embodiment, the front glass substrate 101 and the back glass substrate 102 are stacked together and are secured in position by a plurality of clips 7'. The clamping positions for the clips 7' are the same as those of the fifth embodiment.

The vacuum heating furnace 140 used in this embodiment is heated by a heater (not shown) and the interior of the furnace is evacuated by a vacuum pump (not shown) connected through an outlet 141, creating a high vacuum state in the furnace 140.

Next, a shaped glass frit 131 and a flared duct 132 are secured in position by a clip 7'. The tip of the clip 7' is U-shaped, which enables the clip 7' to secure the flared duct 132 on the back glass substrate 102 with pressing the flared part of the duct 132. A seal head 133 is attached to the non-flared end of the duct 132. The material of a part in seal head 133 is a resin which makes it possible to maintain the vacuum by bringing it into press contact so as to tighten the duct 132 all around. The heat resistance of this resin is approximately 200° C., and, to cool the entire resin, the seal head 133 is provided with a cooling water piping 135 for circulating cooling water.

Further, a through hole 115 of the back glass substrate 102 is connected to an exhaustion/gas-introduction piping 134 through the duct 132. This exhaustion/gas-introduction piping 134 is connected to vacuum equipment and discharge gas supplying equipment through a switching valve (not shown).

The temperature of the pair of substrates put in the vacuum heating furnace 140 is raised to approximately 350° C., at which a change in the substrate performance, due to impurity gases, does not easily occur, at a rapid temperature rise rate such that the substrates do not suffer breakage (T1 in FIG. 14).

Next, the interior of the pair of substrates, stacked together, is evacuated and maintained at approximately 350° C. to 370° C. (T2 in FIG. 14).

At this time, the sealant 104 is not melted yet, so that, as in the fifth embodiment, the impurity gas generated from the substrates can be efficiently removed from the gap 105 (See FIG. 10) between the sealant 104 and the front glass substrate 101. The temperature of the substrates is maintained until the removal of this impurity gas is completed.

Next, the temperature of the substrates, stacked together, is raised to 370° C. to 410°C. (T3 in FIG. 14). At this time, as in the fifth embodiment, the melting and fusion of the sealant 104 are sequentially effected. At the same time, the melting of the shaped glass frit 131 and the fusion of the flared portion of the duct 132 to the back glass substrate 102 are sequentially effected. When the fusion by the sealant 104 and the shaped glass frit 131 is completed, the discharge space 103 formed between the pair of substrates, stacked together, and the duct 132 become a closed system with respect to the exhaustion/gas-introduction piping 134 through the seal head 133, and evacuation is possible through the seal head 133.

Here, the pressure in the discharge space 103, which has become a closed system, is controlled to be a negative pressure with respect to the pressure in the vacuum heating furnace 140, and the in-furnace pressure is set to be constantly pressurizing with respect to the substrates, the deformation of the molten sealant 104 being performed by utilizing this pressurizing force.

Thus, the fifth embodiment, the clamping force of the dips 7 for clamping and fixing the substrates stacked together can be weakened such that any positional deviation of the front glass substrate 101 and the back glass substrate 102 does not occur or the number of clips can be reduced. Further, the periphery of the substrates stacked together is restored to the atmospheric level until the sealant 104 is completely melted.

By this operation, it is possible, as in the fifth embodiment, to cope with the problem due to the growth of the minute bubbles existing in the sealant 104. In the sixth embodiment, in the condition in which the substrates stacked together form a closed system, the interior thereof is not contaminated by impurity gas, so that it is possible to use the atmospheric gas as the leak gas to restore the pressure in the furnace to the atmospheric pressure. Further, the inert gas of high purity and the discharge gas can be processed, using only a very small amount, with which the interior of the substrates stacked together is filled. Further, the processing after the leakage to the atmosphere (T4 through T6 in FIG. 14) can be conducted in the atmospheric-air heating furnace as in the conventional process.

Next, the exhaustion of the interior of the substrates stacked together is continued, and maintained for a fixed period (T4 in FIG. 14) so that there is no remnant of the impurity gas; since most of the impurity gas generated from the substrates is removed by evacuation from the periphery exterior thereof before the fusion of the glass material 104, it is possible to advance to the temperature lowering process (T5 in FIG. 14) in a shorter time than in a conventional method.

Further, leakage of impurity gas, etc. into the interior of the stacked substrates by way of the vacuum heating furnace 140 is not effected as in the fourth embodiment, so that there is no problem due to such contamination by the inert gas, which is advantageous from the viewpoint of yield.

Next, as in the fifth embodiment, the temperature is lowered until the temperature in the interior of the substrates stacked together is room temperature (T6 in FIG. 14), and the filling with discharge gas is conducted through the seal head 133 and the duct 132. Then, the duct 211 is cut away to thereby complete the panel.

In the sixth embodiment, the glass substrates can be held by a weak clamping force, and it is possible to sufficiently remove the impurities in the discharge space 103. Further, it is possible to limit the application of the vacuum heating furnace, which is large-scale equipment, to a very limited period (T2 through T3 in FIG. 14) at approximately 350° C. to 410° C. Further, the sealing of the through-hole 115 can be effected by a conventional method, so that relatively simple equipment suffices, and, further, an improvement can be achieved in terms of reliability.

Figure 15:
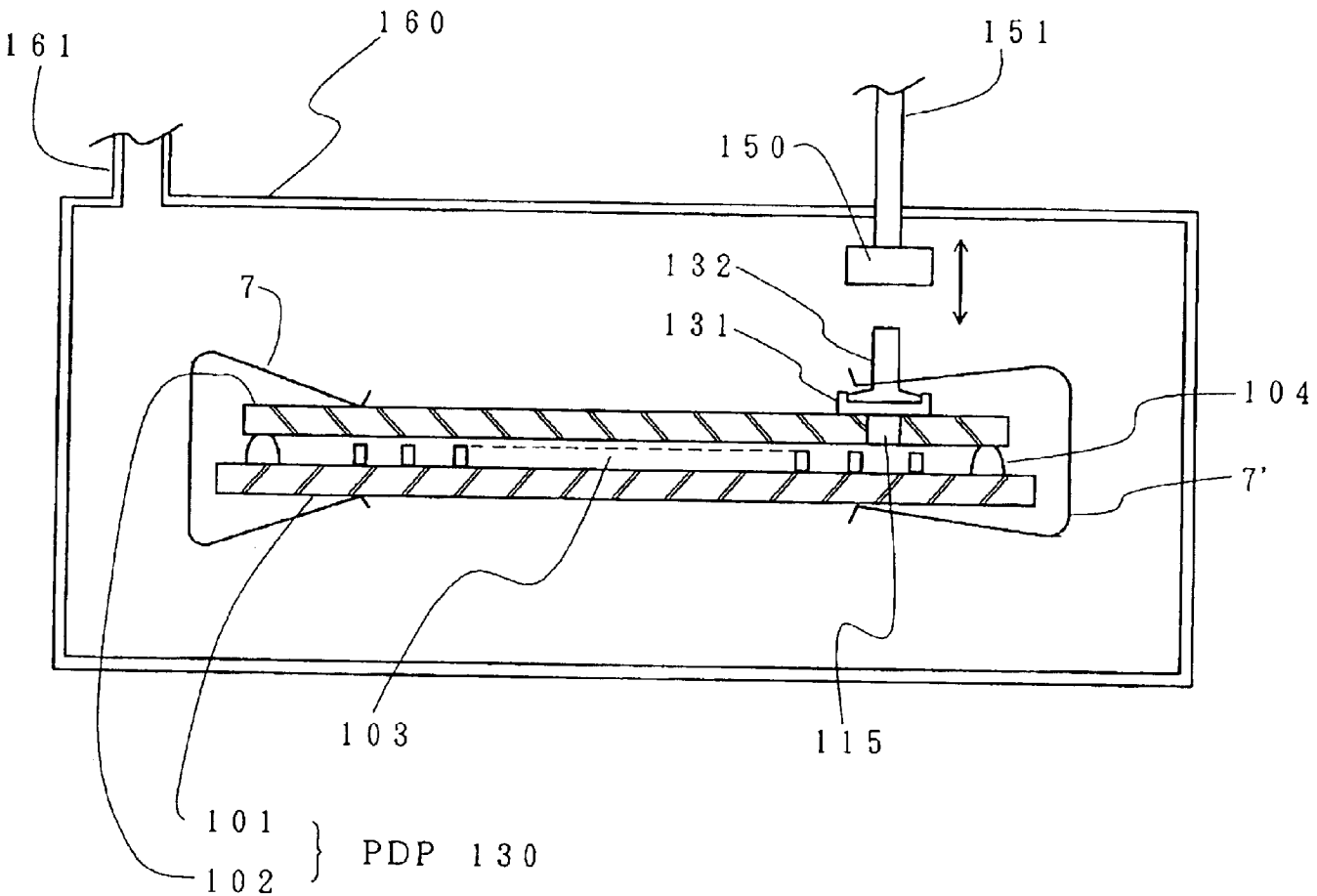
FIG. 15 schematically illustrates a cross-sectional view of a PDP in accordance with a sealing process of a seventh preferred embodiment of the present invention.
Figure 16:
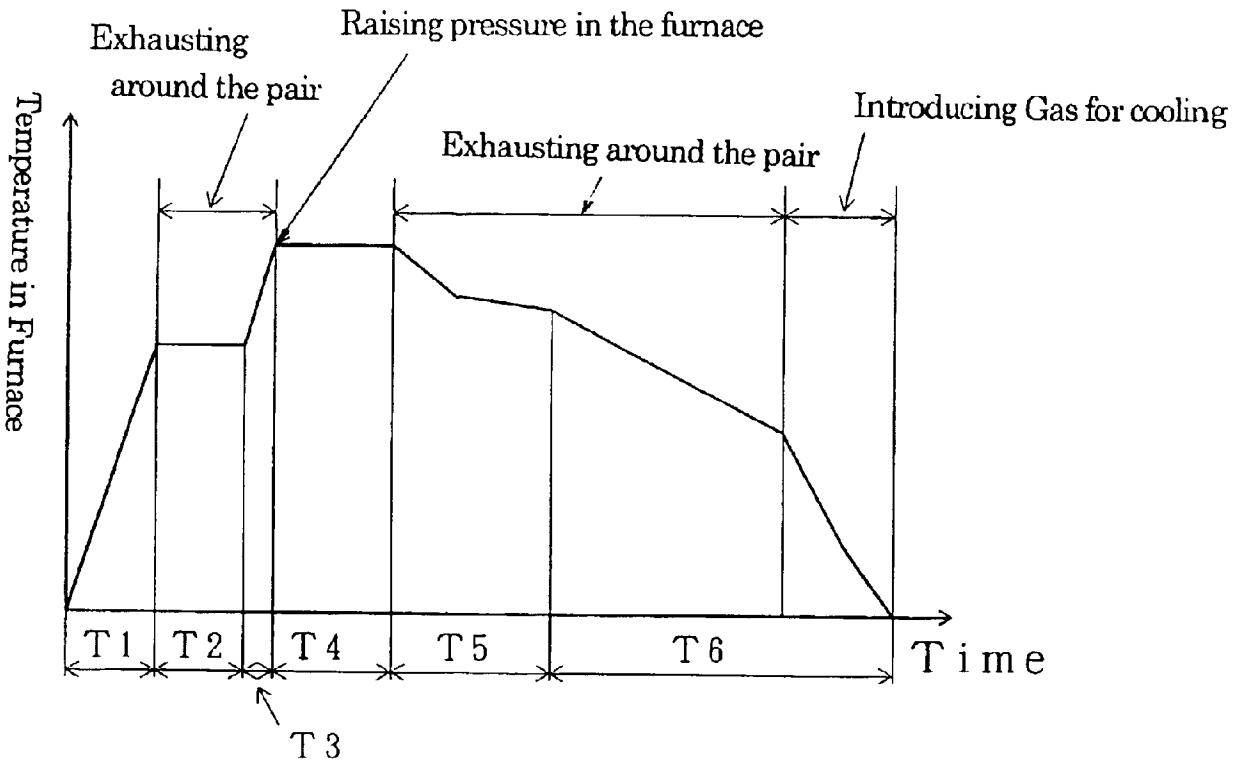
FIG. 16 schematically illustrates a temperature profile in processing cycles of a sealing process in accordance with the seventh preferred embodiment of the present invention.
Figure 17:
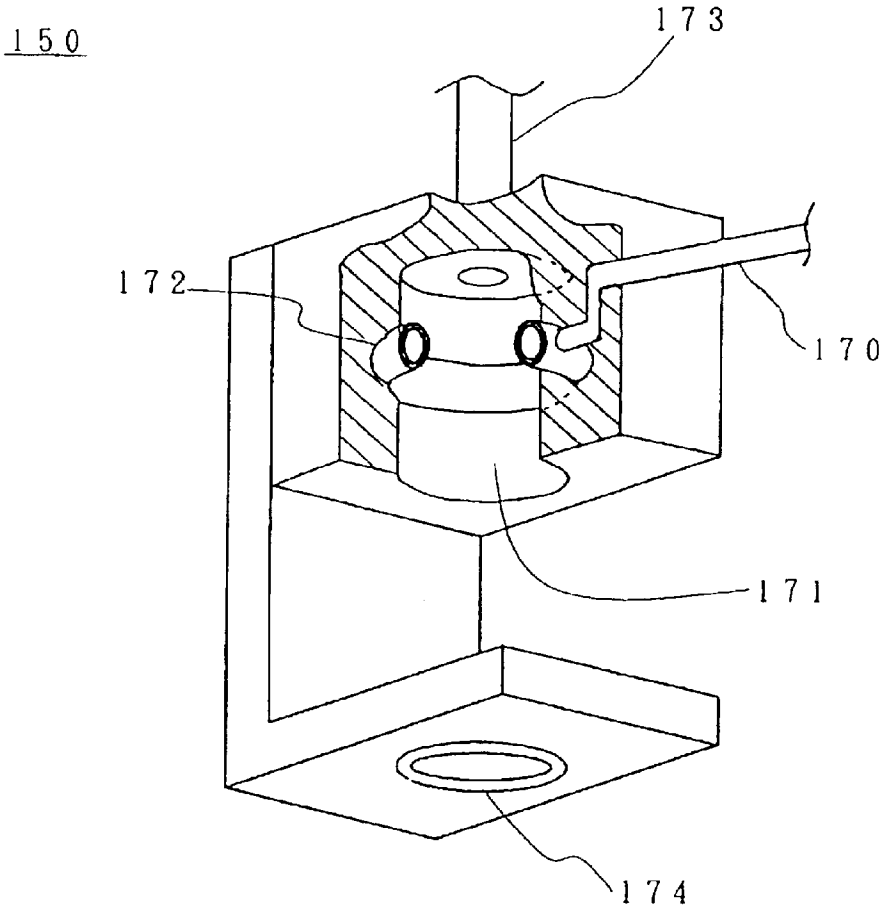
FIG. 17 schematically illustrates a perspective view of a seal-head in accordance with a sixth preferred embodiment.
Figure 18A:
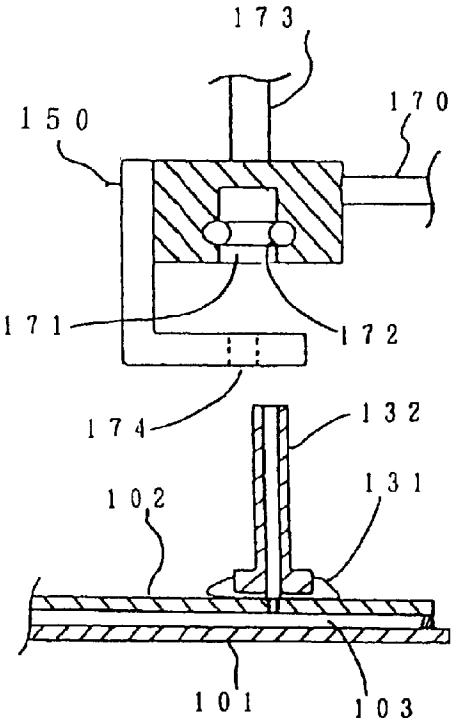
FIG. 18 schematically illustrates operations of the seal-head shown in FIG. 17.
Figure 18B:
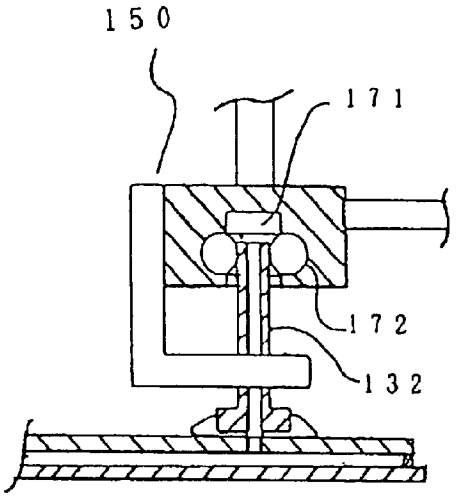

Next, FIGS. 15 through 18 show the seventh embodiment. This embodiment uses the same POP 130 as used in the sixth embodiment. FIG. 15 illustrates the processing of the PDP 130, including the pair of substrates 101 and 102, and FIG. 16 shows the processing cycle. FIG. 17 shows the seal head in detail, and FIG. 18 shows the operation of this seal head. The components which have the same functions as those of the first through six th embodiments are indicated by the same reference numerals, and a description thereof will be omitted.

In the seventh embodiment, there is no need to constantly keep the seal head 150 attached to the duct 132, as in the sixth embodiment, and the periphery of the pair of substrates is required to be held in a high vacuum only during a necessary period, as in the sixth embodiment.

The front glass substrate 101 and the back glass substrate 102 a reformed as in the fifth embodiment. As in the fifth embodiment, the front glass substrate 101 and the back glass substrate 102 are stacked together and secured in position by a plurality of dips 7. The clamping positions of the clips 7 are also the same as in the fifth embodiment, Next, as in the sixth embodiment, the shaped glass frit 131 and the flared duct 132 are secured in position by a clip T. Unlike the sixth embodiment, the non-flared end of the duct 132 is open.

Next, the pair of substrates stacked together is put in the vacuum heating furnace 160, and the temperature is raised (T1 in FIG. 16) to approximately 350° C., at which the exhaust of impurity gas and the change in the substrate performance do not easily occur; th temperature is raised at a rapid rate such that the substrates do not suffer breakage.

Next, the interior of the substrates stacked together is evacuated. The temperature of the substrates stacked together is maintained at approximately 350° C. to 370° C. (T2 in FIG. 16).

At this time, the seal glass 104 is not melted yet, so that, as in the fourth and fifth embodiments, the impurity gas generated from the front and back glass substrates 101 and 102, etc. can be efficiently removed. The substrate temperature is maintained until the removal of the impurity gas is completed (T2 in FIG. 16).

Next, the temperature of the substrates stacked together is raised to 370° C. to 410° C. (T3 in FIG. 16). At this time, as in the second embodiment, the melting a nd fusion of the sealant 104 is sequentially effected. At the same time, the melting of the shaped glass frit 131 and the fusion of the back glass substrate 102 and the flared portion of the duct 132 are also sequentially effected.

Next, as in the fifth embodiment, until the sealant 104 is completely melted, the pressure on the exterior of the substrates stacked together is raised by inert gas or discharge gas introduced through the exhaustion/gas-introduction piping 151, whereby, as in the fourth and fifth embodiments, it is possible to cope with the problem due to the growth of the minute bubbles existing in the sealant 104.

Next, the temperature is lowered to a temperature at which the sealant 104 is cured (T5 in FIG. 16), and the exhaust from the interior of the substrates stacked together is started again. By this exhausting, the minute amount of impurity gas generated during the period T4 in FIG. 16 is more reliably removed. Further, as needed, the temperature is kept constant in T5 of FIG. 16 to thereby remove the impurity gas more reliably.

Next, cooing is effected (T6 in FIG. 16). To improve the cooling efficiency, it is possible to rill the vacuum healing furnace 160 with discharge gas containing no impurity gas, etc. through the exhaustion/gas-introduction piping 151.

Next, after the temperature is lowered until the temperature of the substrates stacked together is room temperature, the seal head 150 is lowered by an ascent/descent mechanism (not shown), and attached to the duct 132. This seal head 150 will be described in detail with reference to FIGS. 17 and 18.

High-pressure air is supplied from an air supply source (not shown) through a valve to the air piping 170 for driving the seal head 150. This high-pressure air is supplied to an O-ring 172 provided on the side wall of a cylindrical portion 171, making it possible to make the inner diameter of the O-ring 172 variable. Further, on the top wall of the cylindrical portion 171, there is provided an exhaustion/gas-introduction piping 173. At the L-shaped forward end in the lower portion of the seal head 150, there is provided a heater 174 for fusing and sealing a part of the duct 132.

Figure 18C:
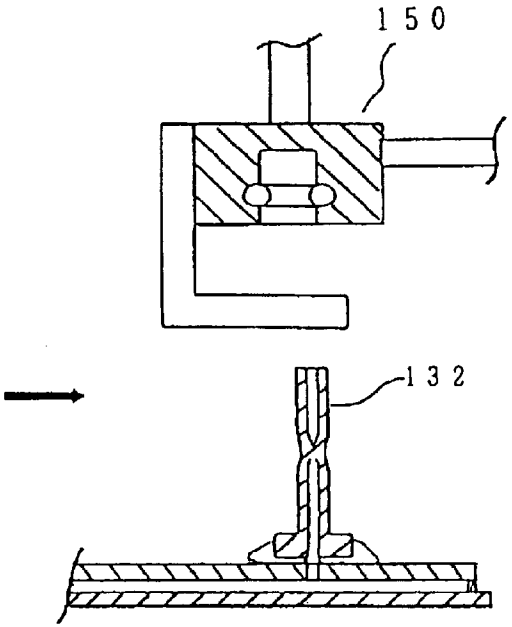
Figure 19:
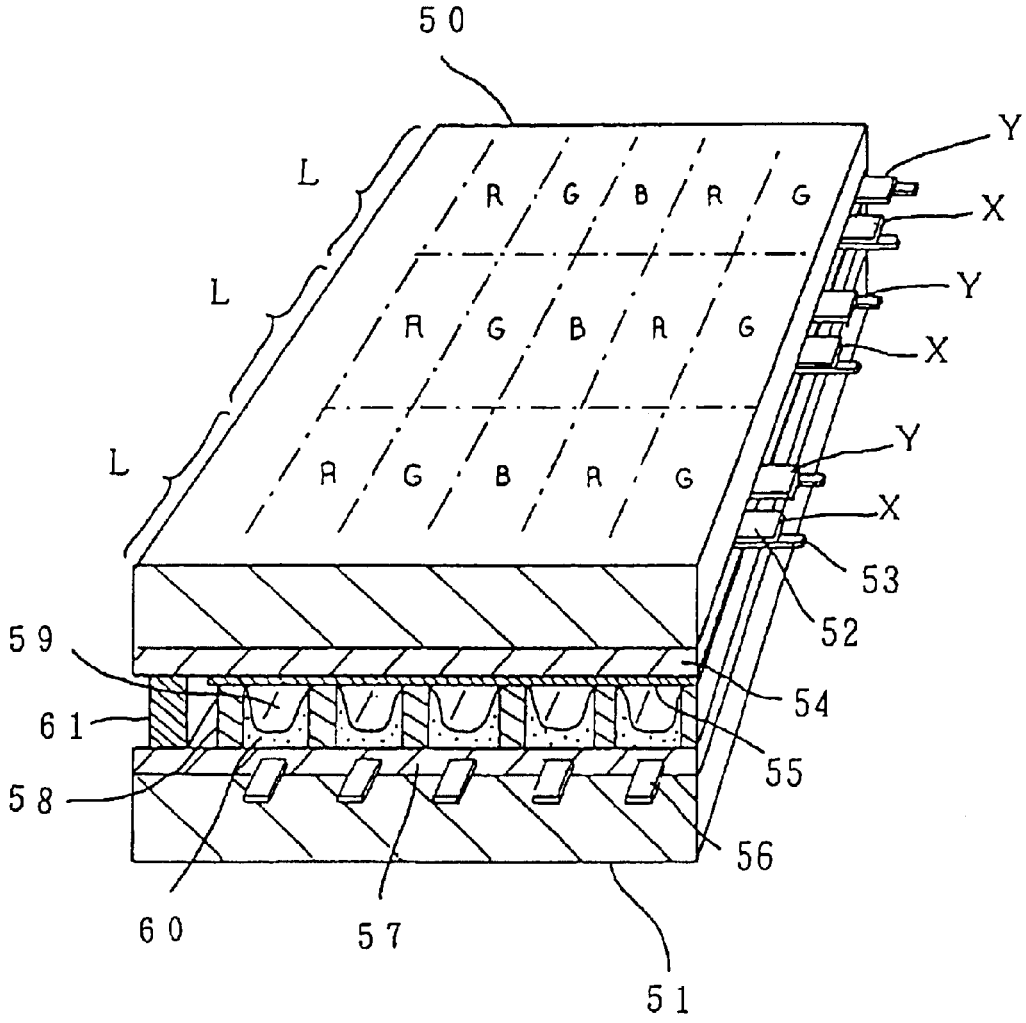
FIG. 19 (PRIOR ART)
FIG. 19 schematically illustrates a perspective view of partially cutting a PDP.
Figure 20A:
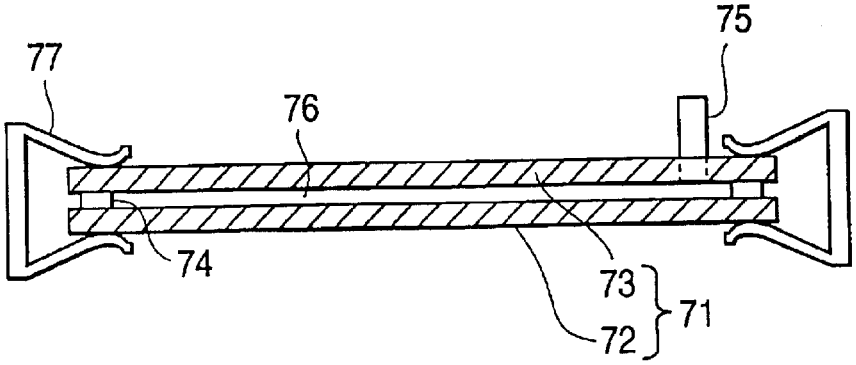
FIG. 20A (PRIOR ART)
FIG. 20A schematically illustrates a cross-sectional view of a prior art PDP.
Figure 20B:
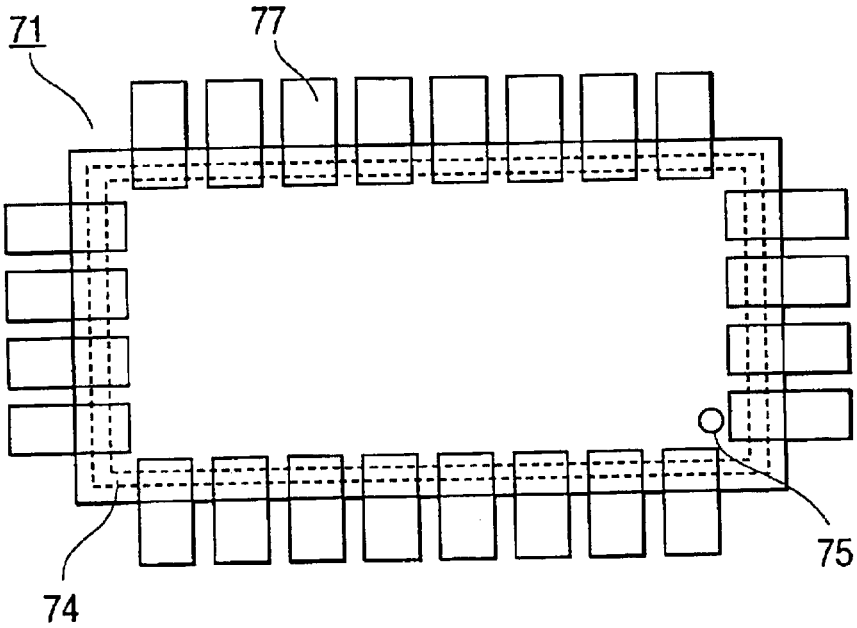
FIG. 20B (PRIOR ART)
FIG. 20B schematically illustrates a planar view of the PDP shown in FIG. 20A.
Figure 21:
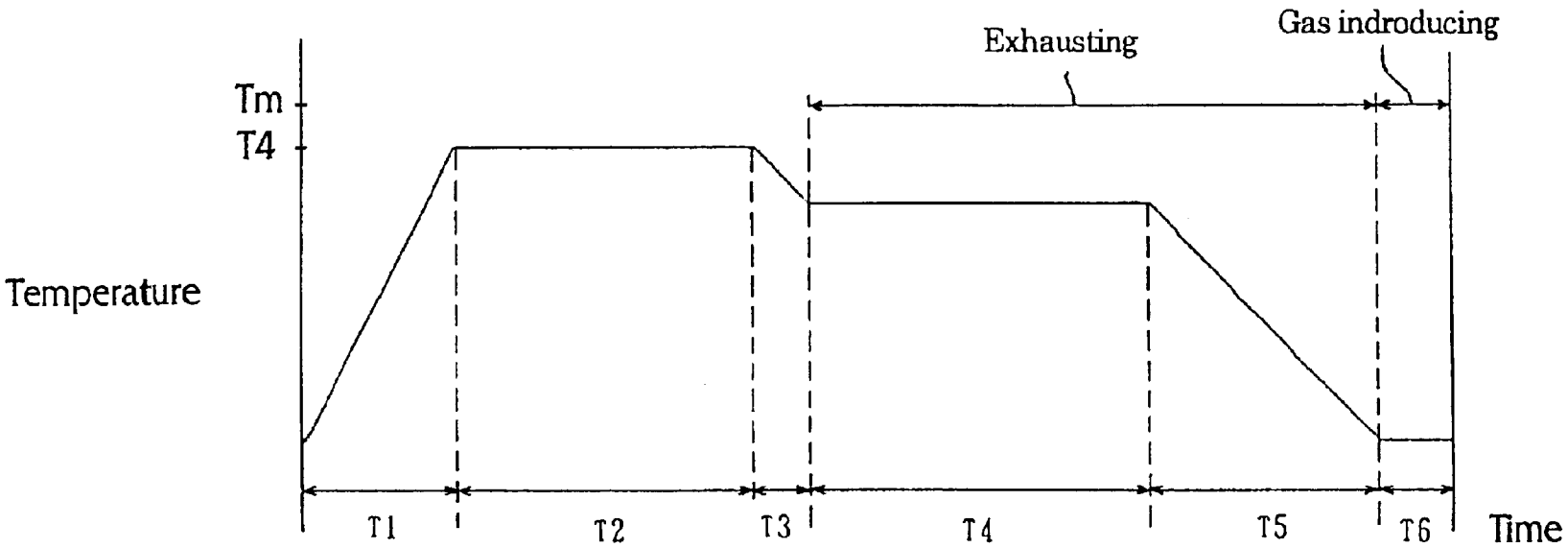
FIG. 21 (PRIOR ART)
FIG. 21 schematically illustrates a temperature profile in a processing cycle of a sealing process of the prior art PDP shown in FIGS. 20A and 20B.

Next, the operation of the seal head will be described with reference to shows the condition before the seal head 150 is lowered, FIG. 1B shows the condition in which the seal head 150 is attached to the duct 132, and FIG. 18C shows the condition in which the seal head 150 is restored to the position of FIG. 8A after the discharge space is filled with a predetermined gas through the seal head 150 and, further, the duct 132 is sealed by the heater 174.

When this seal head is at the lowered position, air is supplied to the O-ring 172, and the inner portion of the O-ring 172 is brought into close contact with the duct 132 (B in FIG. 18). Due to this close contact, the discharge space 103 is connected to the exhaustion/gas-introduction piping 173 through the cylindrical portion 171. Next, the gas introduced at the time of cooling is exhausted by a vacuum pump (not shown) connected to the duct 173, and then the discharge space is filled with discharge gas by way of the exhaustion/gas-introduction piping 173, the seal head 150 and the conduction pipe 132 until a predetermined pressure is reached. Here, when the discharge gas is used as the cooling gas, only the filling pressure of the discharge gas is adjusted.

After this filling, electricity is supplied to the heater 74, and a part of the conduction pipe 132 is fused and sealed, the seal head 150 being raised (FIG. 18C).

In this embodiment, in addition to the impurity removing effect of the fifth and sixth embodiments, there is no need to constantly keep the seal head 133 attached to the conduction pipe 132 as in the fifth embodiment, so that the conveyance of the substrates stacked together, etc. is facilitated. Further, since the seal head is used only at a temperature about room temperature, it is possible to prevent the generation of impurity gas from the seal head. Further, there is no need to use a temperature resistant member, so that a relatively simple equipment suffices, and an improvement is achieved in terms of reliability.

In accordance with the plasma display panel manufacturing method of the present invention, the sealant is melted, with the pressure between the pair of substrates being reduced, so that the sealing is effected as the pair of substrates are drawn to (pushed toward) each other while compressing the sealant due to the difference between the inner and outer pressures. Thus, there is no need to apply mechanical pressure to the substrates from outside, and sealing is achieved without involving any stress. Further, it is possible to substantially shorten the time needed for sealing the pair of substrates by the sealant. Further, the installation time for the jig for applying pressure from outside is shortened, thereby achieving an improvement in terms of mass productivity.

Further, when a plurality of PDPs are obtained from a single substrate, the sealant is arranged in the central portion of the substrate. The sealing of this central portion can also be reliably effected without using any jig.

Further, in accordance with the present invention, the impurities in the discharge space are removed through the gap between the sealant and the substrates, so that the impurities in the discharge space can be removed more reliably, and it is possible to reduce the probability of the impurities from the sealant entering the discharge space, whereby it is possible to improve the operating characteristics and the display characteristics of the plasma display panel.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A method of manufacturing a gas discharge panel having a pair of substrates sealed together with a sealant and defining a discharge space therebetween, comprising:

forming the sealant in a frame-shape on at least one of the pair of substrates, and stacking said substrates, one upon the other via the sealant;

lowering a pressure in the discharge space between the pair of substrates before the sealant starts to melt, relatively to a pressure on an exterior of the pair of substrates, by starting an exhausting operation to exhaust the discharge space via a through hole provided in one of the pair of substrates, while heating and thereby melting the sealant and introducing gas being exterior to the pair of the substrates so as to remove an impurity in the discharge space;

solidifying the sealant so as to fixedly join the pair of substrates with the discharge space therebetween;

exhausting the discharge space; and filling a discharge gas into the discharge space.

2. The method of manufacturing a gas discharge panel as recited in claim 1, wherein, in the second step, the exhausting of the discharge space for lowering the pressure in the discharge space between the substrates and the heating for melting the sealant are begun simultaneously.

3. The method of manufacturing a gas discharge panel as recited in claim 1, further comprising:

providing separator walls on at least one of the substrates, a height of said separator walls defining a height of the discharge space when the pair of substrates compresses the sealant.

4. The method of manufacturing a gas discharge panel as recited in claim 1, wherein a non-continuous barrier wall is provided beforehand in a vicinity of an interior of the sealant so as to prevent an inward invasion of the melted sealant.

5. The method of manufacturing a gas discharge panel as recited in claim 1, wherein:

the forming of the sealant further comprising forming a plurality of said frame-shaped sealants on said one of said substrates; and carrying out the lowering, solidifying, removing and filling for said plurality of frame-shaped sealants and respective plurality of discharge spaces formed within said frame-shaped sealants.

6. The method of manufacturing a gas discharge panel as recited in claim 5, wherein said plurality of discharge spaces are provided with respective through holes in adjacent relationship, so that said exhausting and said discharge gas filling processes are carried out via a pipe connected commonly to each of the respective through holes.

7. The method of manufacturing a gas discharge panel as recited in claim 1, wherein peripheral portions of said pair of substrates are pinched together with temporary fixing clips.

8. A method of manufacturing plural gas discharge panels, each having a respective discharge space, between a pair of substrates, each panel sealed together with a sealant frame, comprising the steps of:

forming a plurality of sealant frames, on a first surface of a first substrate opposing a second substrate and stacking said first substrate onto said second substrate via the plurality of sealant frames, wherein each of the substrates has a plurality of cutting lines defining the plural gas discharge panels, formed with respective sealant frames so as to enclose respective discharge spaces;

lowering an internal pressure of each of the plurality of discharge spaces relatively to a pressure on an exterior of each of the pair of substrates so as to press the pair of the substrates together and to fix a size of the discharge spaces between the pair of the substrates and heating and thereby melting the plurality of sealant frames;

solidifying the plurality of sealant frames, once melted, so as to fix the pair of the substrates and form the plurality of discharge spaces between the pair of substrates;

removing impurities in the discharge spaces;

filling a discharge gas into the discharge spaces and sealing the discharge spaces; and cutting the pair of the substrates along the cutting lines into a plurality of smaller substrates so as to form a plurality of individual said gas discharge panels, wherein said plurality of discharge spaces are provided with a plurality of respective conduction pipes in adjacent relative positions to each other, each extending from an exterior of a respective gas discharge panel to the respective discharge space thereof, and so that said exhausting and said discharge gas filling processes are carried out via a pipe connected commonly to the plurality of conduction pipes.

9. A method of manufacturing a gas discharge panel comprising a pair of substrates opposed to each other, one of the substrates having a plurality of electrodes on a inner surface thereof so as to produce a discharge with adjacent electrodes and the other of the substrates having on an inner surface thereof fluorescent materials of a plurality of different colors for emitting fluorescences stimulated by the discharges and a plurality of separator walls formed in a predetermined pattern separating said fluorescent materials, comprising:

forming a seal glass layer along a periphery of the other substrate, of a height greater than a height of said separator walls;

positioning the pair of substrates, in opposed relationship and separated by a discharge space of a predetermined interval therebetween, in a vacuum-heating furnace;

exhausting the discharge space between the pair of opposed substrates before the sealant starts to melt by lowering a pressure ambient to the pair of opposed substrates; and heating said seal glass layer until said seal glass layer melts while maintaining the low pressure in the discharge space by exhausting the discharge space via a hole provided on one of the pair of substrates.

10. A method of manufacturing a gas discharge panel comprising a pair of substrates having respective pluralities of electrodes thereon and being disposed in opposing relationship with a discharge space therebetween, comprising:

forming a seal-glass layer along a periphery of one of the substrates;

positioning the pair of substrates, in opposed relationship and separated by a discharge space of a predetermined interval therebetween, in a vacuum-heating furnace;

exhausting said discharge space via a leak clearance between the seal-glass layer and the substrate while disposed with a furnace and which maintains a predetermined temperature within the furnace; and lowering the pressure in the discharge space between the pair of the substrates by exhausting same via a conduction pipe, connected to a through hole previously provided in a portion of the other substrate, while the temperature within the furnace is raised to a melting temperature of said seal-glass layer to seal the substrates.

11. The method of manufacturing a gas discharge panel as recited in claim 10, wherein a pressure within the furnace and exterior of the pair of substrates is raised at least once after lowering the pressure exterior of the pair of substrates before melting said seal-glass layer.

12. The method of manufacturing a gas discharge panel as recited in claim 10, further comprising lowering the pressure via a seal-head connected to the conduction pipe.

13. A method of manufacturing a gas discharge panel comprising a pair of substrates defining a discharge space therebetween and having a plurality of separator walls on at least one of the pair of substrates, comprising:

forming a sealant in the shape of a frame on one of the pair of substrates;

stacking the one substrate onto the other substrate;

arranging a formed-glass-frit in a vicinity of and aligned with a through hole in one of the substrates;

heating the pair of substrates so as to raise a temperature of the pair of substrates and exhausting gas from, and lowering a pressure in, a space surrounding the pair of the substrates so as to remove any impurities in the discharge space between the substrates;

melting the sealant;

forming said discharge space to a height determined by a height of the separator walls by deforming the sealant via exhausting the discharge space through the through hole;

cooling the pair of the substrates so as to solidify the sealant;

filling the discharge space with a discharge gas introduced through the through hole in the panel; and sealing the through hole after filling the discharge space with the discharge gas.

14. The method of manufacturing a gas discharge panel as recited in claim 13, wherein the sealant frame is formed of a height greater than a height of the separator walls, clips for pinching and affixing the pair of stacked substrates are located so as to press together respective central portions of the substrates within a vicinity of regions where the separator walls are to engage the other substrate, bending the central portions of the substrates in an inward direction toward the discharge space relatively to the peripheries thereof, spaced apart by the sealant frame.

15. The method of manufacturing a gas discharge panel as recited in claim 13, wherein the deforming of the sealant is caused by a force produced in a direction toward the discharge space from an exterior of both of the pair of substrates by maintaining a pressure in the exterior of the pair of substrates higher than a pressure in the discharge space between the substrates.

16. The method of manufacturing a gas discharge panel as recited in claim 13, wherein the height of the discharge space is determined by closing a portion of a conduction path, from the discharge space to the exterior of the pair of the substrates, so as to provide a uniform pressure-difference between a lower pressure in the discharge space between the substrates and a relatively higher pressure on the exterior of the pair of the substrates.

17. The method of manufacturing a gas discharge panel as recited in claim 13, further comprising, while heating the pair of substrates, exhausting gas from the exterior of the pair of the substrates when the sealant reaches a vicinity of a temperature at which degassing becomes active and is ended when the sealant adheres to the substrate.

18. The method of manufacturing a gas discharge panel as recited in claim 13, wherein, while melting the sealant, raising the pressure in the exterior of the pair of substrates to a level of pressure at which a bubble existing in the sealant does not increase in size.

19. The method of manufacturing a gas discharge display panel as recited in 13, wherein, in the fourth step, melting the sealant at a temperature below a temperature at which softening of the sealant begins, so as to prevent a bubble in the sealant from increasing in size.

20. The method of manufacturing a gas discharge display panel as recited in 13, further comprising connecting a conduction pipe to the through-hole, connecting a seal head, available to exhaust the discharge space, to the conduction pipe after the sealant is solidified and cooled and introducing a discharge gas through the conduction pipe and seal head into the discharge space.

21. The method of manufacturing a gas discharge panel as recited in claim 13, wherein a conduction pipe is connected to the through hole, a seal-head operable to exhaust the discharge space via the conduction pipe is connected to the conduction pipe, and exhausting the discharge space is carried out via the conduction pipe and the seal-head after the sealant adheres to the substrate.

22. The method of manufacturing a gas discharge panel as recited in claim 21, wherein, after the sealant adheres to the substrate, raising the pressure on the exterior of the pair of substrates to a level of a pressure at which a bubble existing in a sealant does not increase in size.

23. The method of manufacturing a gas discharge display panel as recited in 21, further comprising using a heater provided in the seal-head to heat and melt a part of the conduction pipe after introducing the discharge gas into the discharge space via the conduction pipe, so as to seal the discharge space.

24. The method of manufacturing a gas discharge display panel as recited in 23, wherein an ambient pressure on an exterior of the pair of substrates and the part of the conduction pipe to be melted is raised to a higher pressure than that in the discharge space when the part of the conduction pipe is melted.

25. A method of manufacturing a plasma display panel comprising a pair of substrates having a discharge space therebetween and sealed with a sealant, comprising:

forming the sealant in a frame-shape and disposing same so as to extend between the pair of substrates;

beginning exhausting the discharge space through a conduction pipe, secured to at least one of the substrates and communicating with the discharge space;

heating and thereby melting the sealant while continuing exhausting the discharge space through the conduction pipe so as to lower the internal pressure within the discharge space before the sealant starts to melt, relative to an external pressure on the exterior of the substrates, such that the sealant, while melting, is compressed by the external pressure on the pair of substrates, sealing the pair of substrates.

26. The method of manufacturing a plasma display panel as recited in claim 27, further comprising:

after sealing the pair of substrates, heating the discharge space to a temperature lower than a melting point of the sealant and exhausting the interior of the discharge space via the conduction pipe, so as to remove impurities from within the discharge space and thereby purify same; and filling the purified discharge space with a discharge gas via the conduction pipe.

27. The method of manufacturing a plasma display panel as recited in claim 25, wherein a leak clearance is formed between the frame-shaped sealant and at least one of the pair of substrates and the exhausting of the discharge space is performed through both the conduction pipe and the leak clearance.

28. A method of manufacturing a gas discharge panel comprising a pair of substrates opposed to each other, one of the substrates having a plurality of electrodes on a inner surface thereof so as to produce a discharge with adjacent electrodes and the other of the substrates having on an inner surface thereof fluorescent materials of a plurality of different colors for emitting fluorescences stimulated by the discharges and a plurality of separator walls formed in a predetermined pattern separating said fluorescent materials, comprising:

forming a seal glass layer along a periphery of the other substrate, of a height greater than a height of said separator walls;

positioning the pair of substrates, in opposed relationship and separated by a discharge space of a predetermined interval therebetween, in a vacuum-heating furnace;

beginning exhausting the discharge space between the pair of opposed substrates until said seal glass layer begins melting via a conduction pipe to introduce gas ambient to the pair of the substrates so as to remove an impurity in the discharge space, to produce a low pressure therein relative to an exterior pressure on the substrates; and heating said seal glass layer until said seal glass layer melts while maintaining the low pressure in the discharge space by said exhausting.

29. A method of manufacturing a gas discharge panel having a pair of substrates sealed together with a sealant and defining a discharge space therebetween, comprising:

forming the sealant along a periphery of at least one of the substrates, and stacking said substrates, one upon the other;

lowering a pressure in the discharge space between the pair of substrates before the sealant starts to melt, relative to a pressure on exterior of the pair of substrates, by starting an exhausting operation to exhaust the discharge space, while heating and thereby melting the sealant; and sealing the pair of substrates.

30. The method of manufacturing a gas discharge panel as recited in claim 29, further comprising:

filling a discharge gas into the discharge space.

31. The method of manufacturing a gas discharge panel as recited in claim 30, further comprising:

removing an impurity in the discharge space prior to filling the discharge gas thereinto.

32. The method of manufacturing a gas discharge panel as recited in claim 29, further comprising pinching peripheral portions of said stacked substrates together.

33. The method of manufacturing a gas discharge panel as recited in claim 32, further comprising using temporary fixing clips to pinch peripheral portions of said stacked substrates together.

34. The method of manufacturing a gas discharge panel as recited in claim 29, wherein the discharge space communicates through a through hole with an exterior of the gas discharge panel, further comprising exhausting the discharge space via a conduction pipe connected to the through hole.

35. A method of manufacturing a gas discharge panel having a pair of substrates sealed together with a sealant and defining a discharge space therebetween, comprising:

forming the sealant along a periphery of at least one of the substrates, and stacking said substrates, one upon the other;

lowering a pressure in the discharge space between the pair of substrates relative to a pressure on exterior of the pair of substrates, by exhausting the discharge space, while heating and thereby melting the sealant;

sealing the pair of substrates, and prior to forming the sealant, providing a barrier wall on at least one of the pair of substrates so as to prevent an inward invasion of the melted sealant.

36. A method of manufacturing a gas discharge panel having a pair of substrates sealed together with a sealant and defining a discharge space therebetween, comprising:

forming the sealant along a periphery of at least one of the substrates, and stacking said substrates, one upon the other;

lowering a pressure in the discharge space between the pair of substrates before the sealant starts to swell, relative to a pressure on exterior of the pair of substrates, by starting an exhausting operation to exhaust the discharge space, while heating and thereby melting the sealant, lowering the temperature to solidify the sealant for a predetermined period of time; and stopping the exhausting operation and introducing a discharge gas into the discharge space.

* * * * *

UNITED STATES PATENT AND TRADEMARK OFFICE

CERTIFICATE OF CORRECTION

PATENT NO. : 6,827,623 B2
DATED : December 7, 2004
INVENTOR(S) : Fumiaki Nakatake et al.

It is certified that error appears in the above-identified patent and that said Letters Patent is hereby corrected as shown below:

Column 24,
Line 24, change "claim 27" to -- claim 25 --.

Signed and Sealed this

Twenty-eighth Day of June, 2005

JON W. DUDAS
*Director of the United States Patent and Trademark Office*